United States Patent [19]

Suga

[11] Patent Number: 4,991,156

[45] Date of Patent: Feb. 5, 1991

[54] ELECTRONIC TIME MEASURING APPARATUS INCLUDING PAST RECORD DISPLAY MEANS

[75] Inventor: Fusao Suga, Akishima, Japan

[73] Assignee: Casio Computer Co., Ltd., Tokyo, Japan

[21] Appl. No.: 284,938

[22] Filed: Dec. 15, 1988

Related U.S. Application Data

[62] Division of Ser. No. 29,531, Mar. 23, 1987, Pat. No. 4,831,605.

[30] Foreign Application Priority Data

Mar. 25, 1986 [JP] Japan ..... 61-64879
Mar. 25, 1986 [JP] Japan ..... 61-64880

[51] Int. Cl.[5] ..... G04F 8/00

[52] U.S. Cl. ..... 368/113; 368/28; 368/62; 368/89

[58] Field of Search ..... 368/89, 107–113, 368/118, 62, 28

[56] References Cited

U.S. PATENT DOCUMENTS 4,831,605 5/1989 Suga ..... 368/113

*Primary Examiner*—Bernard Roskoski
*Attorney, Agent, or Firm*—Frishauf, Holtz, Goodman & Woodward

[57] ABSTRACT

An electronic stop watch measures an elapsed time, and stores each measured elapsed time together with measurement date data. The measurement date data is also read out and displayed when the stored elapsed time is read out and displayed, so as to represent when the readout and displayed elapsed time was measured.

8 Claims, 17 Drawing Sheets

START
T11
1/100 SEC ELAPSED?
NO
YES
T12
V=1 ?
NO
YES
T13
S=1 ?
NO
YES
T14
O=1 ?
NO
YES
TIME MEASUREMENT PROCESSING
T15
T16
SECOND CARRY ?
NO
YES
ALARM PROCESSING
T17
T18
SECOND CARRY ?
NO
YES
T19
S=1 ?
NO
YES
T20
T=1 ?
NO
YES
T21
CO ← CO+1
T24
CO ← CO+1
T22
CO=5 ?
NO
T25
CO=5 ?
NO
T23
S ← 0
V ← 1
T26
T ← 0
W ← 1
T27
DISPLAY PROCESSING
END

START
D = 1 ?
NO
T121
YES
D ← 0
E ← 1
T122
Xn ← 0
T123
IS MEASUREMENT DATE DATA PRESENT ?
T124
NO
YES
MEASUREMENT DATE/ START DATE
T125
M<S
M = S
M>S
T126
Xn ← Xn + 1
T127
Xn = 50 ?
NO
YES
E ← 0
D ← 1
F ← 1
T128
T129
G ← Xn
T130
MEASUREMENT DATA DISPLAY
END

ELECTRONIC TIME MEASURING APPARATUS INCLUDING PAST RECORD DISPLAY MEANS

This is a division of application Ser. No. 07/029,531 filed Mar. 23, 1987 now U.S. Pat. No. 4,831,605, issued May 16, 1989.

BACKGROUND OF THE INVENTION

1. Field of the Invention

The present invention relates to an electronic time measuring apparatus, such as a stop watch or a chronograph (a watch with a stop watch function), for measuring an elapsed time from an arbitrary time instance.

2. Description of Related Art

In conventional stop watches, a stop watch having a memory for sequentially recording measurement times including lap times and split times which have been acquired during a time measurement operation in a memory, is known. However, a stop watch of this type can only record single acquired time data. Therefore, the next measurement must be performed after the content of the memory storing the present measurement data is cleared. Such a conventional stop watch is known from, for instance, Japanese patent disclosure No. 58-213280 opened on Dec. 12, 1983.

However, it is important for those who do time trial sports like track and field, swimming and the like, to compare previous and present time records during training. Thus, measurement data for a plurality of times of trials can be sequentially stored in a memory, so that the desired measurement data is selectively displayed. However, if the measurement data is simply recorded, an operator cannot recognize when the displayed data was recorded. For this reason, he does not know a degree of progress in his records or progress in records in association with a training menu, resulting in inconvenience.

SUMMARY OF THE INVENTION

It is therefore an object of the present invention to provide a time measuring apparatus, useful in sports training, which can record a plurality of pieces or sets of measurement data, and allows accurate and easy confirmation as to when each measurement data was recorded.

To achieve these objects, the present invention provides an electronic stop watch which comprises: means for generating a reference clock signal; elapsed time measuring means for counting the reference clock signal to measure a plurality of elapsed times and to obtain a plurality of elapsed time data; memory means for storing the plurality of elapsed time data obtained by the elapsed time measuring means as a plurality of measurement time data; display means for displaying data; and display control means, coupled to the display means and to the memory means, for displaying on the display means the measurement time data stored in the memory means, and for obtaining and displaying on the display means at least one of an average time, a best time, and a worst time of the measurement time data.

DETAILED DESCRIPTION OF THE PREFERRED EMBODIMENTS

An embodiment of the present invention will now be described hereinafter in detail with reference to the accompanying drawings. In this embodiment, the present invention is applied to an electronic wristwatch having a stop watch function.

DEFINITION

In this specification, "split time" defines an elapsed time from a start time instance to a present time instance. "Lap time" defines a time required for circling a track field, or an elapsed time in a predetermined section in a long distance race, such as marathon. Furthermore, "finish time" defines an elapsed time from a start time instance to a stop (race end) time instance. These "split time", "elapsed time", and "finish time" are as a whole also called "time data", and "date" is called "date data".

ARRANGEMENT OF ELECTRONIC WRISTWATCH

Figure 1:
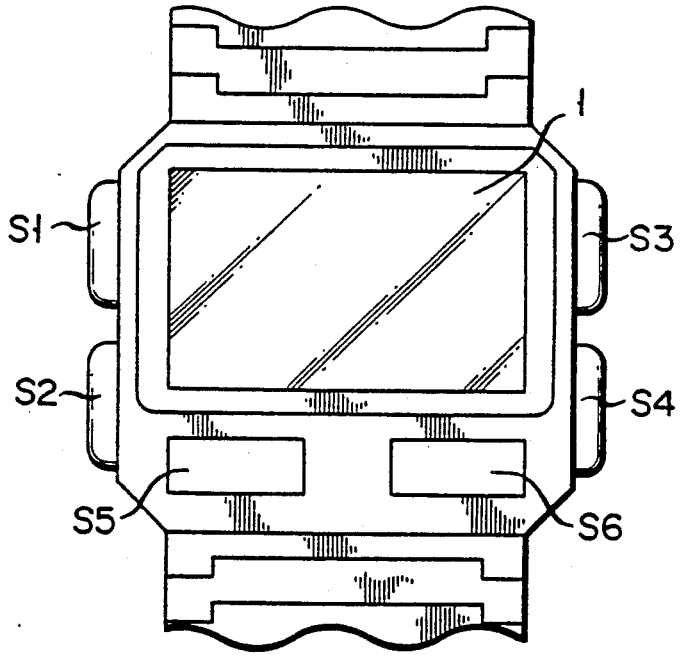
FIG. 1 is a view showing the outer appearance of an electronic wristwatch having a stop watch function employing the present invention.

FIG. 1 shows the outer appearance of the electronic wristwatch. In FIG. 1, reference numeral 1 denotes a liquid crystal display device arranged on the front surface portion of a watch casing. Two each of six button switches S1 to S6 are arranged on the front surface portion, right side portion, and left side portion of the watch casing, respectively. Switch S1 is a basic mode switch for switching a basic timepiece mode, stop watch mode, and other function mode, and switches S2 to S6 are switches used as various function switches in the stop watch mode and other modes.

Figure 2:
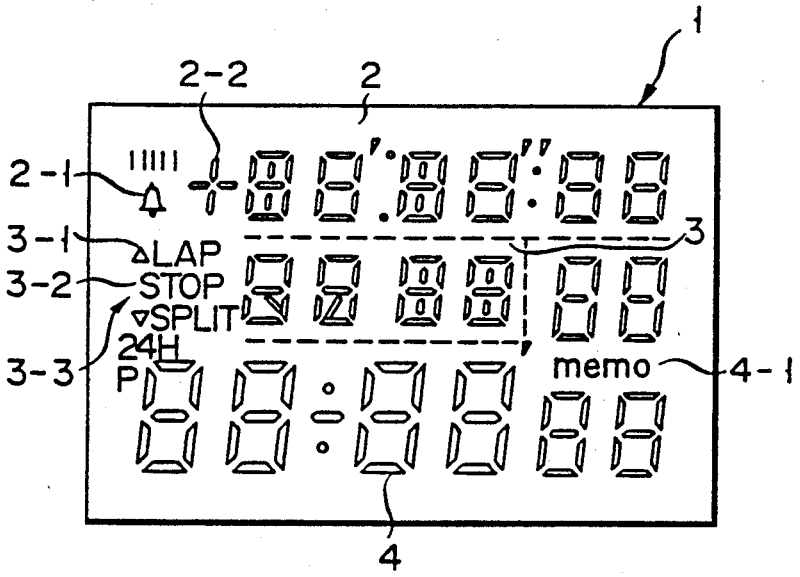
FIG. 2 is a display pattern displayed on a display unit of the wristwatch shown in FIG. 1.

Liquid-crystal display device 1 is arranged as shown in FIG. 2. Device 1 is of a segment display type, and principally has upper display section 2, middle display section 3, and lower display section 4, as divided by broken lines in FIG. 2. Upper display section 2 has a 6-digit configuration, middle display section 3 has a 4-digit configuration, and lower display section 4 has an 8-digit configuration. Upper and middle display sections 2 and 3 display numerals or letters, and lower display section 4 displays numerals. Alarm-on mark display segment 2-1 and plus/minus display segment 2-2 are arranged on the left end portion of display section 2. As will be described later, plus/minus display segment 2-2 indicates whether a time difference between a measured split time and a preset target time is plus or minus. Lap display segment 3-1 for indicating that measurement time data displayed on display section 2 corresponds to a lap time, stop display segment 3-2 for indicating a stop state of a measurement operation, and split display segment 3-3 for indicating that measurement time data displayed on display section 4 corresponds to a split time, are arranged on the left end portion of middle display section 3. Record mode display segment 4-1 for indicating a record mode state capable of recording measurement time data, and other display segments for indicating p.m., 24-hour indication, and the like are arranged on lower display section 4.

Figure 3:
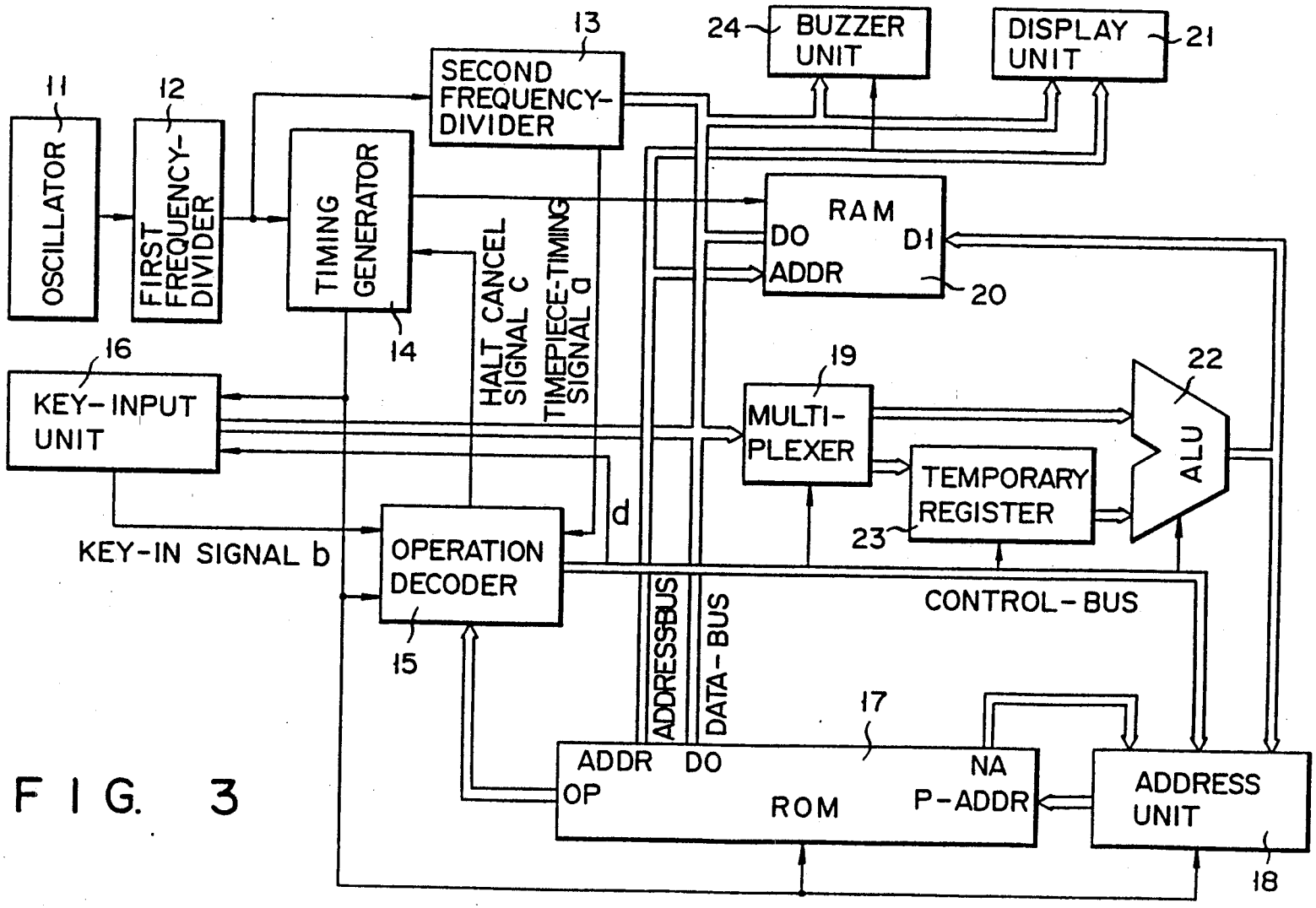
FIG. 3 is a circuit block diagram of the wristwatch shown in FIG. 1.

FIG. 3 is a basic block diagram of the electronic wristwatch. The wristwatch is operated under the control of a microprogram.

A 32.768-KHz reference clock signal output from oscillator 11, for example, is frequency-divided by first frequency divider 12 to 2,048 Hz, and the resultant signal is supplied to second frequency divider 13. Second frequency divider 13 outputs timepiece-timing signal a at equal intervals, e.g., every 1/100 second, and supplies it to operation decoder 15. The 2,048-Hz signal output from first frequency divider 12 is supplied to timing generator 14. Timing generator 14 outputs a timing signal to various circuit components while HALT cancel signal c is kept supplied from operation decoder 15. The timing signal is supplied to operation decoder 15, key-in unit 16, ROM (Read Only Memory) 17, address unit 18, and the like. When any of switches S1 to S6 is depressed, key-in unit 16 supplies a key code signal corresponding to the depressed switch to multiplexer 19, and supplies key-in signal b to operation decoder 15. When operation decoder 15 receives timepiece timing signal a from second frequency divider 13, it outputs HALT cancel signal c for canceling a HALT state of the circuit system to timing generator 14, so as to cause it to generate a timing signal. In addition, operation decoder 15 supplies a timepiece instruction to address unit 18 through a control bus, thereby executing timepiece processing. When key-in signal b is input from key-in unit 16, operation decoder 15 supplies HALT cancel signal c to timing generator 14 to cause it to generate a timing signal, and supplies a key-processing instruction to address unit 18 through the control bus, thereby executing key processing. When the timepiece processing or key processing is completed, operation decoder 15 stops supply of HALT cancel signal c to timing generator 14.

ROM 17 stores the above-described microprogram for controlling the overall operation of the electronic wristwatch, and parallel-outputs microinstructions ADDR, DO, NA, and OP. Microinstruction ADDR is input to RAM (Random Access Memory) 20 as address data, and is also input to display unit 21. Microinstruction DO is input to multiplexer 19 as a numerical code. Multiplexer 19 also receives data from key-in unit 16, the content of second frequency divider 13, and output data from RAM 20. Multiplexer 19 selectively outputs these data at various processing timings, and supplies them to ALU (arithmetic logic unit) 22 and temporary register 23. In this case, data held in temporary register 23 is supplied to ALU 22 in synchronism with data output of multiplexer 19. Microinstruction NA is input to address unit 18 as next address data for reading out various microinstructions necessary for the next processing from ROM 17. Microinstruction OP is input to operation decoder 15.

ALU 22 is adopted to execute various arithmetic operations for executing key processing, timepiece processing, and the like, and the result data is input to address unit 18 and RAM 20. Address unit 18 converts addresses of ROM 17 upon execution of a judgement arithmetic operation in ALU 22. Data written in RAM 20 is read out at various processing timings, and is input to multiplexer 19, display unit 21, and buzzer unit 24.

Operation decoder 15 decodes microinstruction OP, outputs various control signals, and supplies these control signals to key-in unit 16, address unit 18, multiplexer 19, ALU 22, temporary register 23, and the like.

Figure 4:
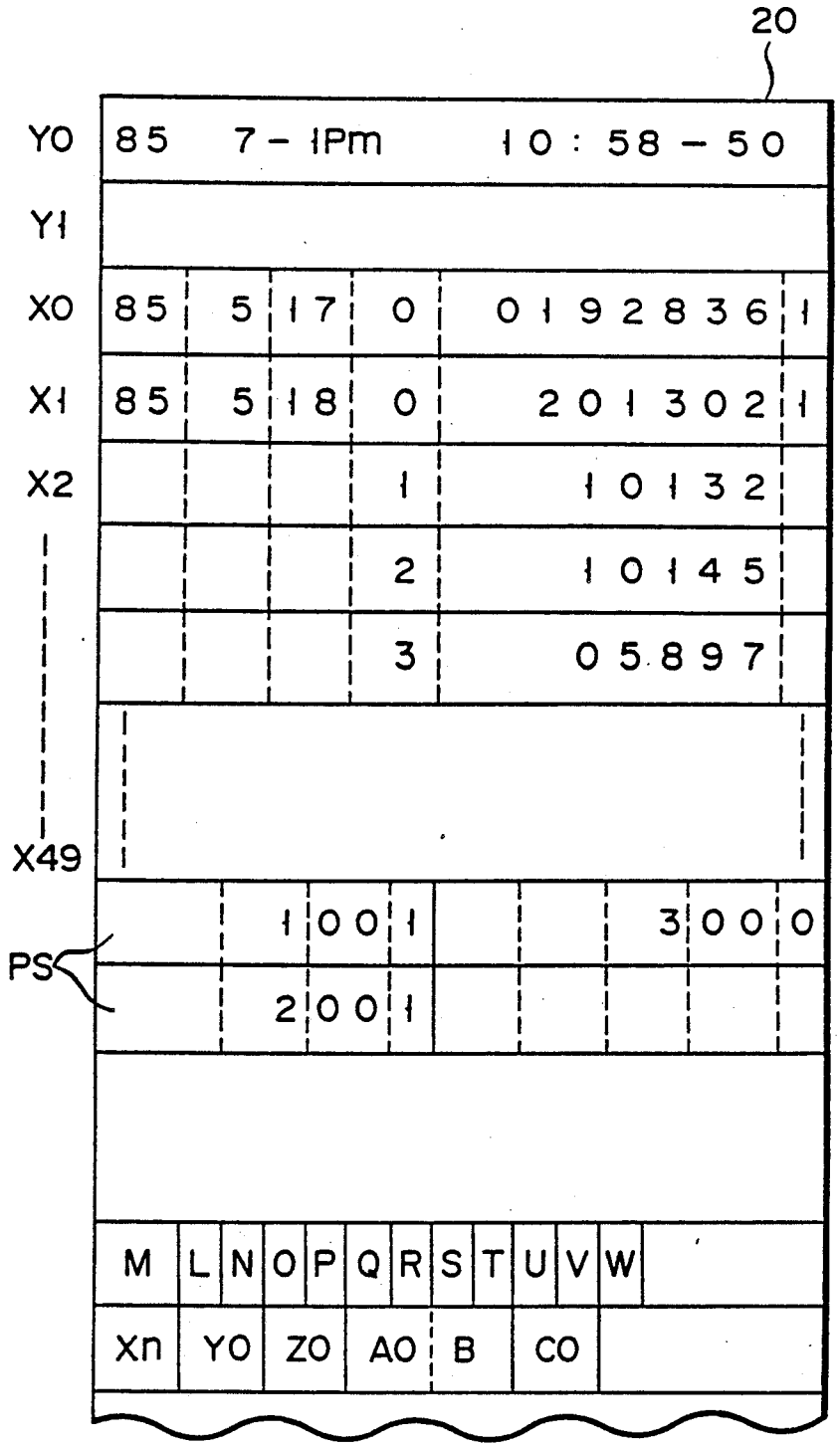
FIG. 4 is a memory map of RAM 20 shown in FIG. 3.

The memory map of RAM 20 will be explained with reference to FIG. 4. RAM 20 stores timepiece data and measured time data. Timepiece register Y0 stores timepiece data, i.e., present time instance and date data. Measurement register Y1 stores time data of the stop watch, which is presently being measured. RAM 20 includes 50 data memories X0 to X49. Data memories X0 to X49 sequentially store measurement time data on the measurement order, and each measurement time data is stored together with timepiece data, e.g., date data. For example, if the first measurement was performed on [May 17, 1985] and a measurement time corresponding thereto is [19′ 28″ 36], measurement date data [May 17, 1985] and measurement time data [19′ 28″ 36] are stored in data memory X0, as shown in FIG. 4. Note that code "0" which is stored between measurement date data and measurement time data is an identification code indicating that the measurement time data represents a measurement time from start to stop. Data "1" recorded on the right side of measurement time data is data indicating the number of measurement times during a corresponding day. If a second measurement is performed on [May 18, 1985], similar data, i.e., measurement date data [May 18, 1985] and measurement time data [20′ 13″ 02], identification code "0" indicating that this measurement time data corresponds to a measurement time from start to stop, and data "1" indicating the first number of measurement times in that day are stored in data memory Xl. When lap time measurement is performed during time measurement, each lap time data is sequentially stored in the next data memory together with data indicating the number of measurement times. For example, if lap time measurement is performed three times during the second measurement described above, data "1", "2", and "3" indicating the number of times of lap time measurement and lap time data [1′ 01″ 32], [1′ 01″ 45], and [58″ 97] are stored in data memories X2 to X4, as shown in FIG. 4. RAM 20 also includes target time setting memory PS for storing target times such as goal time or split time. Target time setting memory PS can store a plurality of target values. FIG. 4 exemplifies a case wherein memory PS stores target times [1′ 00″], [2′ 00″], and [3′ 00″]. Note that data "1" and "0" stored on the right side of each target value are flag data for designating whether or not an alarm is generated when the measuring time data has reached a target time.

FUNCTIONS OF MODE REGISTER

RAM 20 includes mode registers M, L, N, 0, P, Q, R, S, T, U, V, and W (see FIG. 4). Functions of the mode registers will now be described.

MODE REGISTER M

Mode register M is adopted to designate a basic mode. When its content is M=0, a basic timepiece mode is set, when M=1, a stop watch mode is set, and when M=2, other function mode is set.

MODE REGISTER L

Mode register L is adopted to designate a detailed mode of the stop watch mode. When the content is "1", a reset mode indicating a reset state (clear state) before stop watch measurement is started is set.

MODE REGISTER N

Mode register N is adopted to designate a detailed mode of the stop watch mode. When the content is "1", an all-data recall mode for sequentially reading out and displaying all the measurement data stored in data memories X0 to X49 is set.

MODE REGISTER O

Mode register O is adopted to designate a detailed mode of the stop watch mode. When the content is "1", a target time display mode for displaying a target time set in target time setting memory PS of RAM 20 during time measurement operation is set.

MODE REGISTER P

Mode register P is adopted to designate a detailed mode of the stop watch mode. When the content is "1", a present data recall mode for sequentially reading out and displaying present measurement data stored in RAM 20 is set.

MODE REGISTER Q

Mode register Q is adopted to designate a detailed mode of the stop watch mode. When the content is "1", a target time setting mode for setting a target time such as split time in advance in target time setting memory PS of RAM 20 is set.

MODE REGISTER R

Mode register R is adopted to designate a detailed mode of the stop watch mode. When the content is "1", a lap time display mode for displaying a lap time is set.

MODE REGISTER S

Mode register S is adopted to designate a detailed mode of the stop watch mode. When the content is "1", a lap time measurement mode for maintaining the measurement operation during the lap time display is set.

MODE REGISTER T

Mode register T is adopted to designate a detailed mode of the stop watch mode. When the content is "1", a lap time stop mode for interrupting the measurement operation during the lap time display is set.

MODE REGISTER U

Mode register U is adopted to designate a detailed mode of the stop watch mode. When the content is "1", a time difference display mode for calculating and displaying a time difference between a split time obtained at the lap time measurement and the preset target split time is set.

MODE REGISTER V

Mode register V is adopted to designate a detailed mode of the stop watch mode. When the content is "1,", a stop watch measurement mode for displaying a measurement time during the stop watch measurement operation is set.

MODE REGISTER W

Mode register W is adopted to designate a detailed mode of the stop watch mode. When the content is "1", a stop watch stop mode for stopping the measurement operation during the stop watch measurement mode is set.

RAM 20 also includes address pointer Xn for designating addresses of data memories X0 to X49, address pointer Yn for designating addresses of timepiece register Y0 and measurement register Y1, empty address register Z0 for storing address data of a head data memory of nonused data memories, present start address register A0 for storing address data of a data memory which is used first in present measurement, mode counter B for designating a mode for displaying best, worst and average measurement data, and 5-second counter C0 for automatically canceling the lap time display mode.

OPERATION OF WRISTWATCH

The operation of this embodiment will now be described with reference to FIGS. 5 to 13.

The circuit system of the electronic wristwatch of the embodiment shown in FIG. 3 is normally set in a HALT state, and is operated only when a timepiece-timing signal a is output from second frequency divider 13 or when a key-in signal b is output from key-in unit 16.

Figure 5:
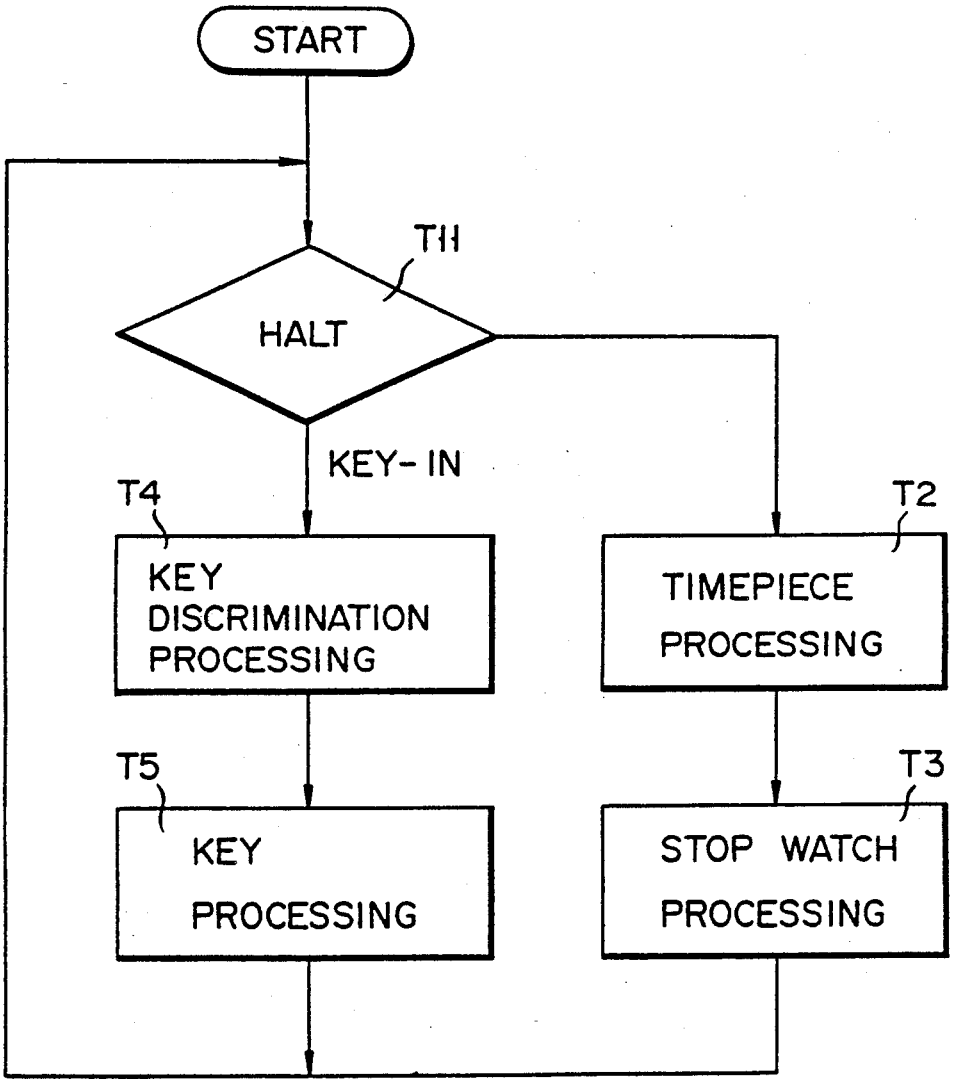
FIG. 5 is a general flowchart of the circuit shown in FIG. 3.

FIG. 5 is a general flowchart of the circuit system. Step $T_1$ represents a state wherein the circuit system is in a HALT state, and awaits outputting of the timepiece-timing signal a or key-in signal b. When the timepiece-timing signal a is detected in step T1, timepiece processing for incrementing present time data and present date data is executed in step T2, and stop watch processing is executed in step T3. If the key-in signal is detected in step T1, key discrimination processing for discriminating the type of depressed key is executed in step T4, and key processing corresponding to the depressed key is executed in step T5.

Figure 6:
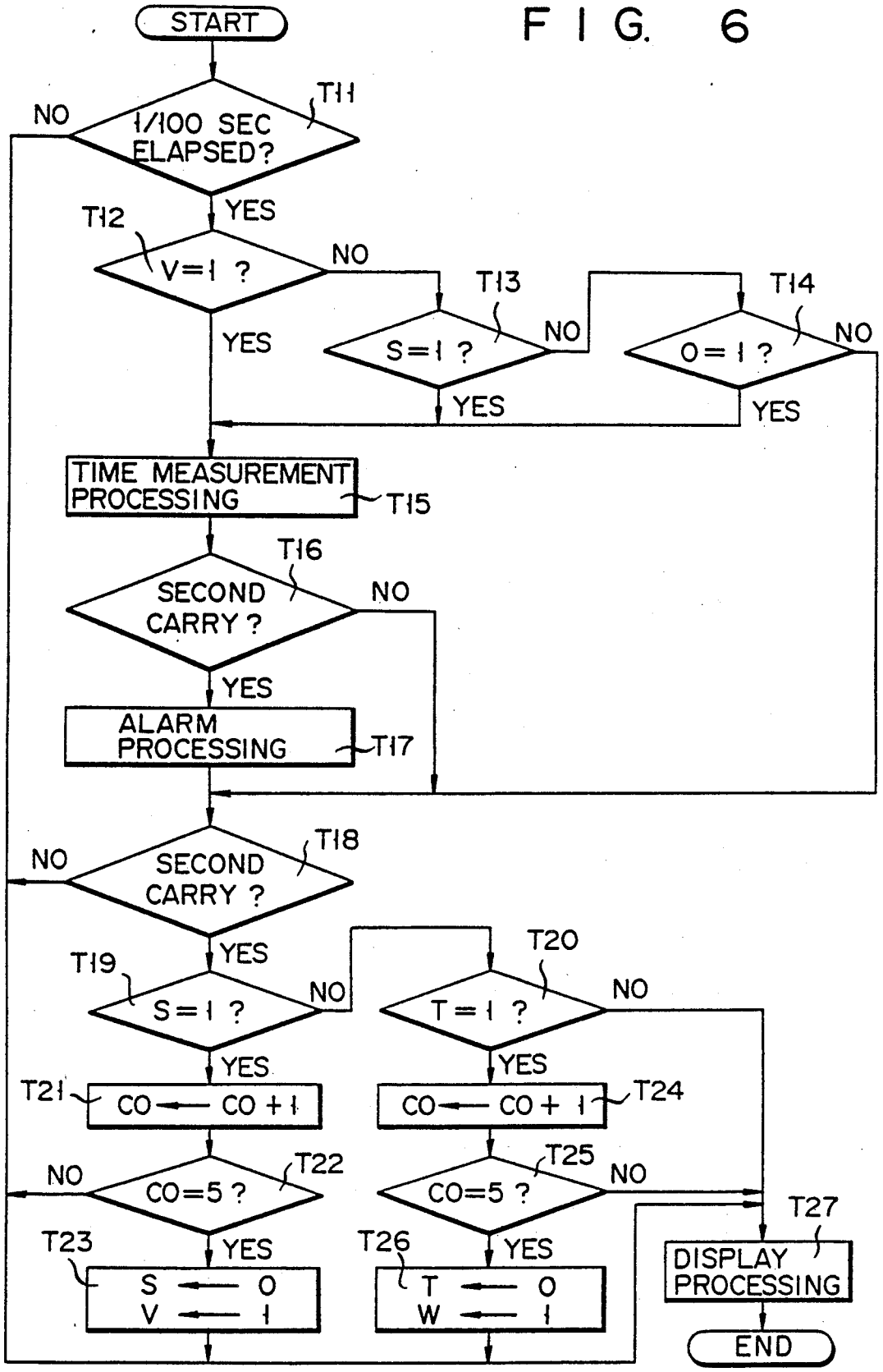
FIG. 6 is a detail flowchart of stop watch processing shown in FIG. 5.

FIG. 6 is a flowchart showing a detailed content of stop watch processing in step T3 shown in FIG. 5. When the control system advances to this flow, it is checked in step T11 if a measurement timing corresponds to 1/100 second If NO in step T11, the flow jumps to display processing in step T27. If YES in step T11, the contents of mode registers V, S, and O are sequentially checked in steps T12 to T14. In other words, it is checked if the detailed mode of the stop watch is set in any of stop watch measurement mode (V=1), lap measurement mode (S=1), and target time display mode (O=1). If the detail mode is set in any of the modes described above, the flow advances to step T15, and time measurement processing is executed, so that time data of 1/100 second is added to the content of measurement register Y1, thereby updating the measurement time of the stop watch. If the detailed mode of the stop watch is not set in any of the three modes described above, time measurement processing in step T15 and alarm processing in step T17 (to be described later) are not executed After the time measurement processing in step T15 is completed, the flow advances to step T16 to check if a second carry is performed in step T15. If YES in step T16, the flow advances to step T17, and alarm processing is executed. In step T17, target time data, whose flag data is set in an alarm ON mode, of target times prestored in target time setting memory PS of RAM 20 is compared with measurement time data stored in measurement register Y1 and if a coincidence is found therebetween, an alarm sound is produced. Thereafter, the flow advances step T18. On the other hand, if NO in step T17, the flow directly advances to step T18.

It is checked in step T18 if a second carry is performed in timepiece processing in step T2 shown in FIG. 5. If NO in step T18, the flow jumps to display processing in step T27. However, if YES in step T18, the contents of mode registers S and T are checked in steps T19 and T20. In other words, it is checked if the detail mode of the stop watch is set in either of lap time measurement mode (S=1) and lap stop mode (T=1). If the lap time measurement mode (S=1) is set, 5-second counter C0 (to be described later) is incremented by +1 to enable an automatic return function, in step T21, and it is checked in step T22 if the content of the 5-second counter has reached "5". If YES in step T22, the flow advances to step T23, and the content of mode register S is set to be "0" and the content of mode register V is set to be "1". In this manner, mode updating processing is performed. More specifically, when five seconds have passed in the lap time measurement mode (S=1), the lap time measurement mode is canceled, and the detailed mode is automatically switched to stop watch measurement mode (V=1). If the lap stop mode is detected in step T20, the content of 5-second counter C0 is incremented by +1 in order to enable the automatic return function as described above, in step T24, and it is checked in step T25 if the content of 5-second counter C0 has reached "5". If YES in step T25, the content of mode register T is set to be "0" in step T26, and the content of mode register W is set to be "1" in step T26. Thus, the mode updating processing is performed. More specifically, when five seconds have passed in the lap time stop mode (T=1), the lap time stop mode is canceled, and is automatically switched to the stop watch stop mode (W=1). When the mode updating processing in step T23 or T26 is completed, the flow advances to step T27, and display processing corresponding to the selected mode is executed. If it is not detected in step T19 or T20 that the lap time measurement mode or lap time stop mode is set, or if it is determined in step T22 or T25 if the content of 5-second counter C0 is not "5", the flow advances to step T27, respectively, and the display processing is executed. After the execution of the display processing, the stop watch processing is completed, and this flow ends.

KEY OPERATIONS

Figure 12:
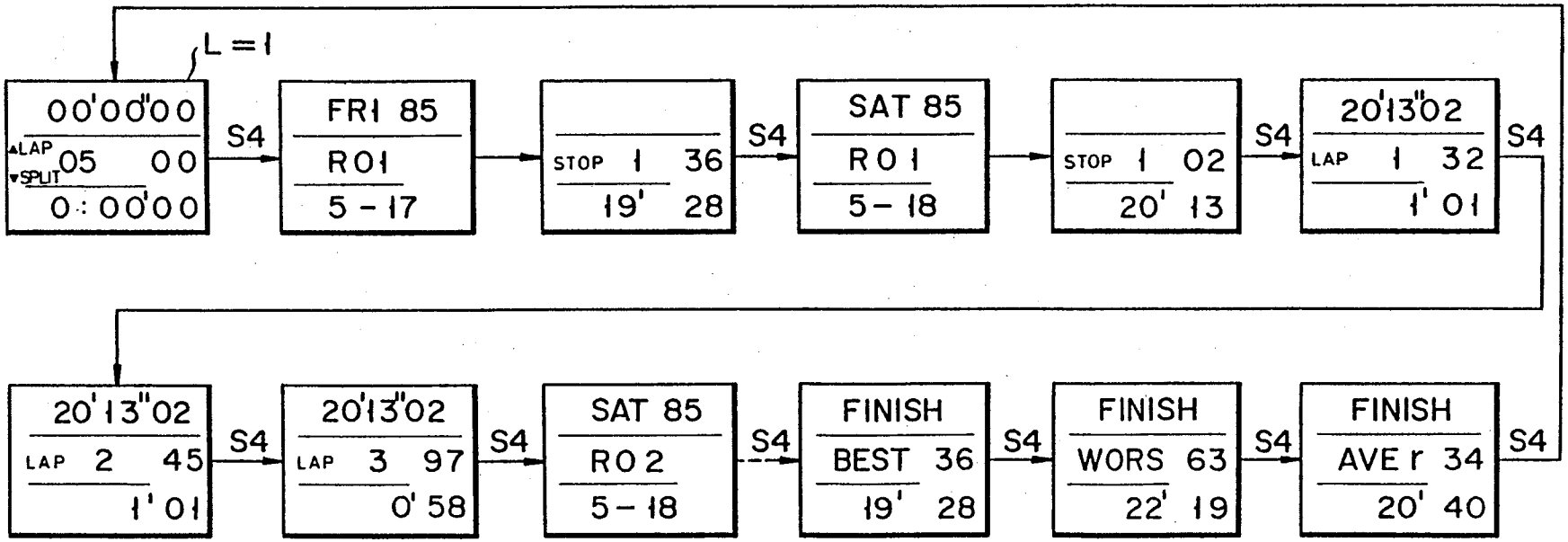
FIG. 12 is a diagram showing display states in an all-data recall mode.
Figure 13:
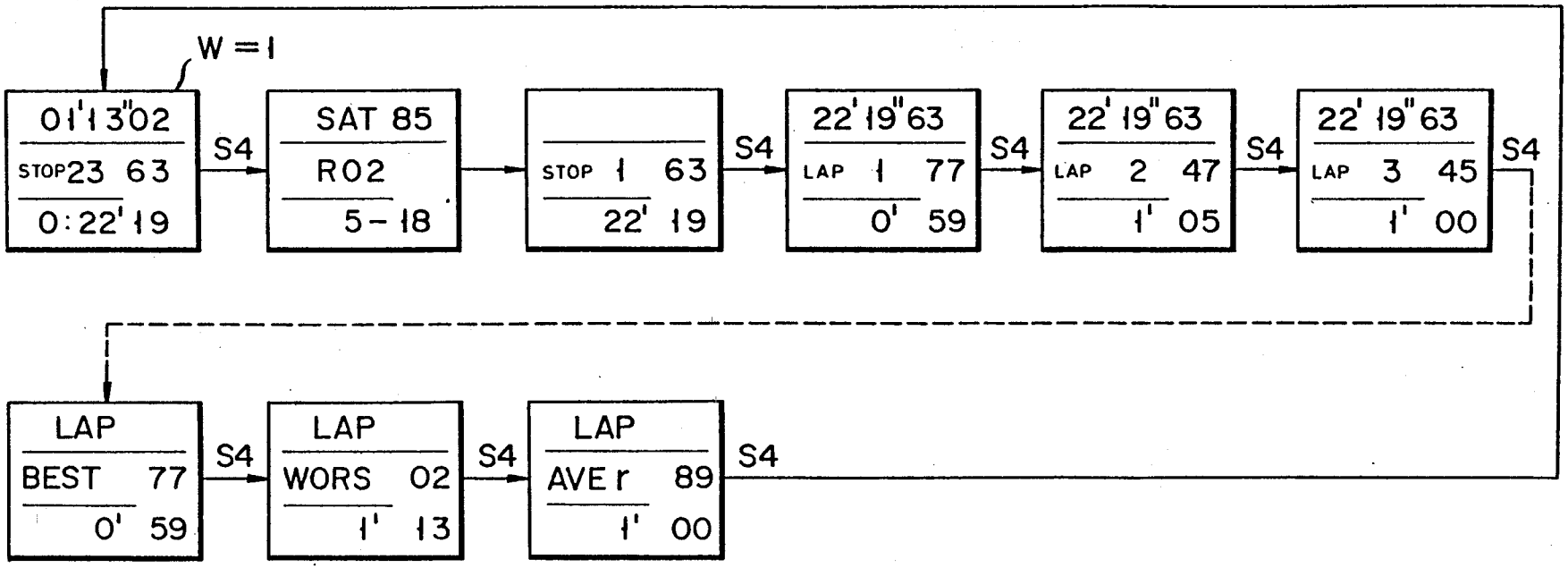
FIG. 13 is a diagram showing display states in a present data recall mode.

The key processing in step T5 shown in FIG. 5, principally, the key processing in the stop watch mode, will be described with reference to the flowcharts shown in FIGS. 7 to 10 and the display diagrams shown in FIGS. 11 to 13.

KEY OPERATIONS OF SWITCH S1

The key Processing for switch S1 will now be described.

Switch S1 is adopted to switch the basic mode. Each time switch S1 is operated, the content of mode register M is changed, like "0", "1", "2", "0", . . . . When M=0, the basic timepiece mode is selected, when M=1, the stop watch mode is selected, and when M=2, other function mode is selected. Each time switch S1 is operated, these modes cyclically appear. FIG. 11 shows the display state in this case. In the basic timepiece mode (M=0), upper display section 2 displays a day of the week and year, middle display section 3 displays a month and day, and lower display section 4 displays an hour, minute, and second. When switch S1 is operated once in the basic timepiece mode, the content of mode register M is updated to "1", and the stop watch mode is selected. When switch S1 is operated in the stop watch mode, the stop watch mode is canceled, and is switched to other function mode (M=2). The detailed mode of the stop watch when the mode is switched from the basic timepiece mode (M=0) to the stop watch mode (M=1), corresponds to any of the reset mode (L=1), stop watch measurement mode (V=1), or stop watch stop mode (W=1). More specifically, if the previous switching operation from the stop watch mode (M=1) to the other function mode (M=2) is performed while the stop watch is in the reset state, i.e., while the detailed mode corresponds to the reset mode (L=1), all-data recall mode (N=1), or target time setting mode (Q=1), the reset mode (L=1) is automatically selected. If the switching operation is performed while stop watch measurement operation is being performed, i.e., while the detailed mode corresponds to the stop watch measurement mode (V=1), target time display mode (O=1), or lap time measurement mode (S=1), the stop watch measurement mode (V=1) is automatically selected. If the switching operation is performed while the stop watch measurement is stopped, i.e., while the detailed mode corresponds to the stop watch stop mode (W=1), present data recall mode, (P=1), or lap time stop mode (T=1), the stop watch stop mode (W=1) is automatically selected. The display states in the respective detail modes will be described in the following description of the key processing.

KEY OPERATIONS OF SWITCH S2

The key processing for switch S2 will be described below. Switch S2 is used in various modes, as described above. In the stop watch mode, switch S2 is enabled in any of the reset mode (L=1), stop watch measurement mode (V=1), stop watch stop mode (W=1), lap time measurement mode (S=1), and lap stop mode (T=1).

Figure 7:
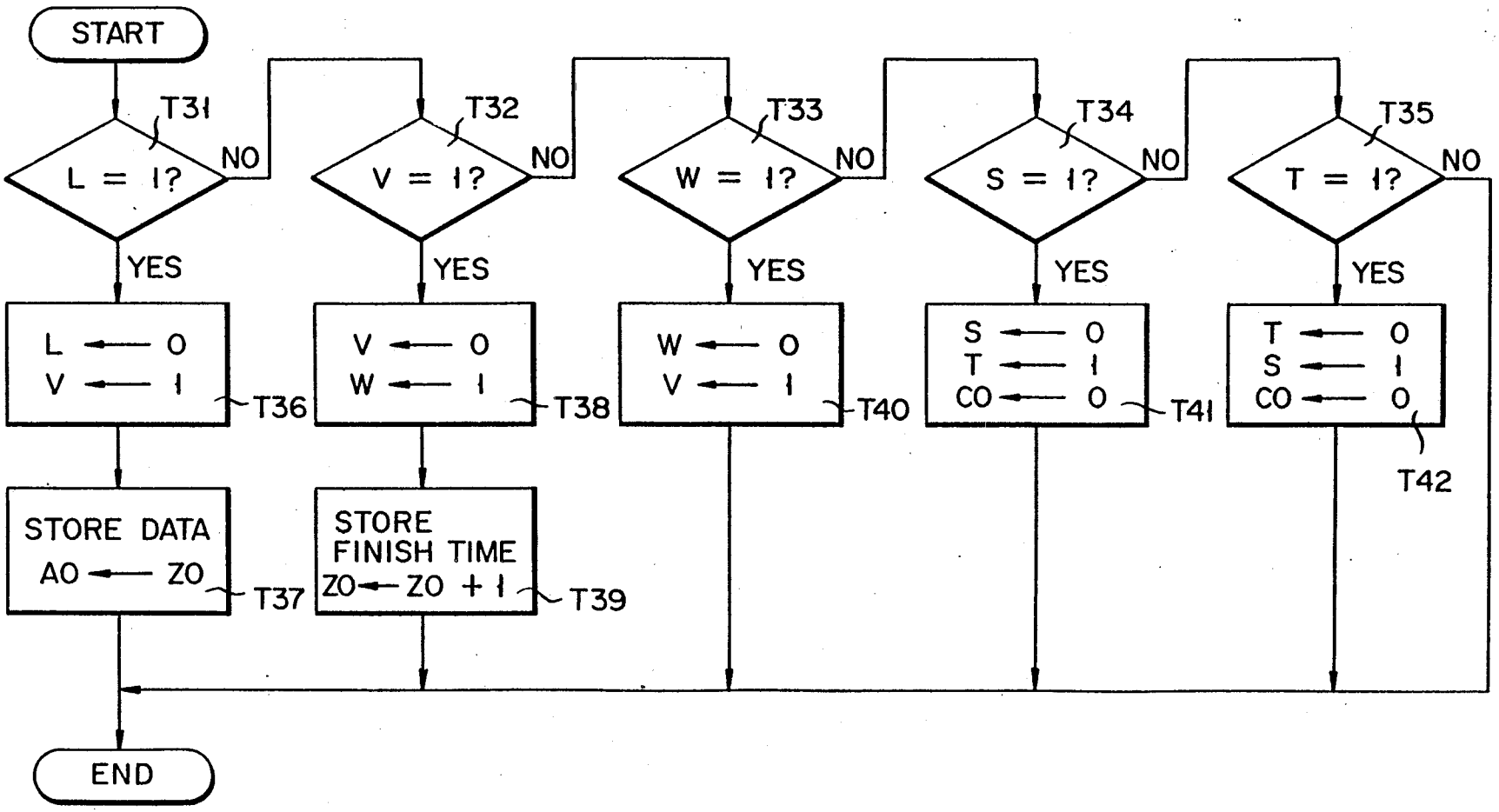
FIG. 7 is a flowchart of key processing when switch 2 is operated in a stop watch mode.

FIG. 7 is a flowchart when switch S2 is operated in the stop watch mode. When switch S2 is operated in the stop watch mode, the contents of mode registers L, V, W, S, and T are checked respectively in steps T31 to T35, thereby discriminating a present mode.

Figure 11:
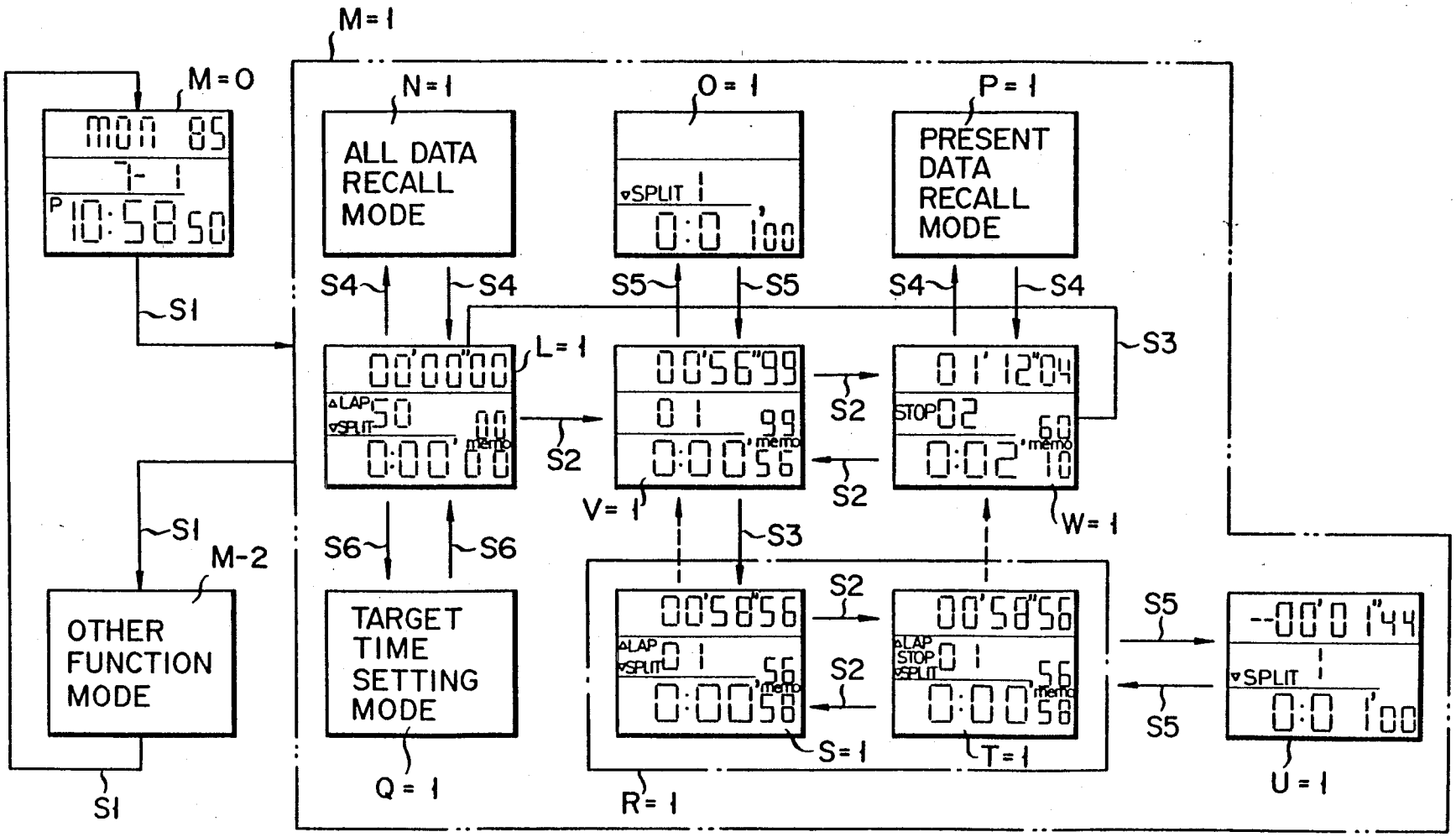
FIG. 11 is a diagram showing display states in respective modes which are changed upon operation of the switches.

Assuming that the detail mode of the stop watch is set in the reset mode (L=1), the remaining number of data memories X0 to X49, e.g., "50", is displayed on middle display section 3, and "0"s are displayed on all the digits of upper and lower display sections 2 and 4, as indicated by L=1 in FIG. 11. Thus, the operator can confirm the number of measurement data to be recorded using the remaining number of data memories.

START/STOP OPERATIONS

If switch S2 is operated in this state, i.e., in the reset mode (L=1), this is detected in step T31, and the flow advances to step T36. In step T36, the content of mode register L is set to be "0", and the content of mode register V is set to be "1". In this manner, the mode updating processing is performed. In other words, the reset mode is canceled, and the stop watch measurement mode (V=1) is automatically selected. In step T37, present date data stored in timepiece register Y0 is read out, and is stored in the corresponding data memory of RAM 20. In this case, the content of address register Z0 is transferred to present start address register A0, and date data is written in a data memory designated by the content of register A0, e.g., data memory X0 if the present measurement corresponds to the first measurement. Therefore, when switch S2 is operated in the reset mode, the stop watch measurement mode is set, and the measurement operation is started. At the same time, present date data is stored in a first nonused data memory of the data memory section. Identification code "0", indicating that measurement time data recorded in correspondence with the date data is a measurement time (i.e., a finish time) from start to stop, is added to the date data in the corresponding data memory. When the stop watch measurement mode is set in this manner, the measurement time from start, e.g., [56" 99] is digitally displayed on upper and lower display sections 2 and 4, as indicated by V=1 in FIG. 11, and the number of used data memories during present measurement, i.e., "01", is displayed on middle display section 3. If there are nonused data memories, record mode display segment 4-1 is turned on so as to represent that at least one lap measurement is allowed in addition to a finish time obtained by the present measurement.

When switch S2 is depressed in the stop watch measurement mode (V=1) which is detected in step T31, the flow advances to step T38. In step T38, the content of mode register V is set to be "0", and the content of mode register W is set to be "1", thus performing the mode updating processing. Thus, the measurement mode is canceled, and the stop watch stop mode (W=1) is selected. The flow then advances to step T39, and the content of measurement register Y1 upon operation of switch S2, i.e., the measurement time (finish time) from the measurement start instance, is stored in a data memory designated by the content of present start address register A0, and the content of empty address register Z0 is incremented by +1. Therefore, when switch S2 is operated in the stop watch measurement mode, the stop watch stop mode is selected, and the measurement operation is stopped. In addition, the measurement time when the operation is stopped is stored as the finish time. When the stop watch stop mode is set, the latest lap time, e.g., [1' 12" 04], is displayed on upper display section 2, and the measurement time from the measurement start, e.g., [2' 10" 60], is displayed on lower display section 4. In addition, the number of used data memories during the present measurement, e.g., "02", is displayed on middle display section 3 together with the stop mark display segment. Turning on of the stop mark can represent that the measurement time digitally displayed on lower display section 4 corresponds to the finish time.

When switch S2 is operated in the stop watch stop mode (W=1), this is detected in step T33, and the flow advances to step T40. Then, the content of mode register W is set to be "0", and the content of mode register V is set to be "1". In this manner, the mode updating processing is performed. More specifically, the stop watch stop mode is canceled, and the stop watch measurement mode is selected, thus restarting the measurement operation. In this case, the measurement time, i.e., the content of measurement register Y1, is a sum of the immediately preceding finish time and the present measurement time.

Before the present measurement operation commences, data measured during the immediately preceding measurement is held in the data memory without being cleared, and the accumulated finish time data presently obtained is recorded in the next unused data memory of the data memory section in correspondence with the date data. Therefore, in this embodiment, a maximum of 50 measurement data can be stored in correspondence with 50 data memories X0 to X49. If 50 data memories are necessary during single measurement, the content of the memories are cleared in advance.

START/STOP OPERATION IN LAP TIME DISPLAY MODE

Switch S2 functions as an effective key in the lap time display mode (R=1). When switch S2 is operated while the time measurement operation of the stop watch continues in the lap time display mode, i.e., in the lap time measurement mode (S=1), this is detected in step T34, and the flow advances to step T41. The content of mode register S is set to be "0", and the content of mode register T is set to be "1". Thus, the mode updating processing is performed, thereby switching from the lap measurement mode (S=1) to the lap stop mode (T=1). Then, 5-second counter C0 for performing the mode updating processing in step T26 shown in FIG. 6 is cleared and started. When switch S2 is operated in the lap time stop mode (T=1), this is detected in step T35, and the flow advances to step T42. The content of mode register T is set to be "0", and the content of mode register S is set to be "1". In this manner, the mode updating processing is performed, thereby switching from the lap time stop mode (T=1) to the lap time measurement mode (S=1). In addition, 5-second counter C0 for performing the mode updating processing in step T23 shown in FIG. 6 is cleared and started.

KEY OPERATIONS OF SWITCH S3

The key processing for switch S3 will be described below. Switch S3 is used in various modes. In the stop watch mode, switch S3 is enabled when the detailed mode is set in any of the stop watch measurement mode (V=1), lap time measurement mode (S=1), and stop watch stop mode (W=1).

Figure 8:
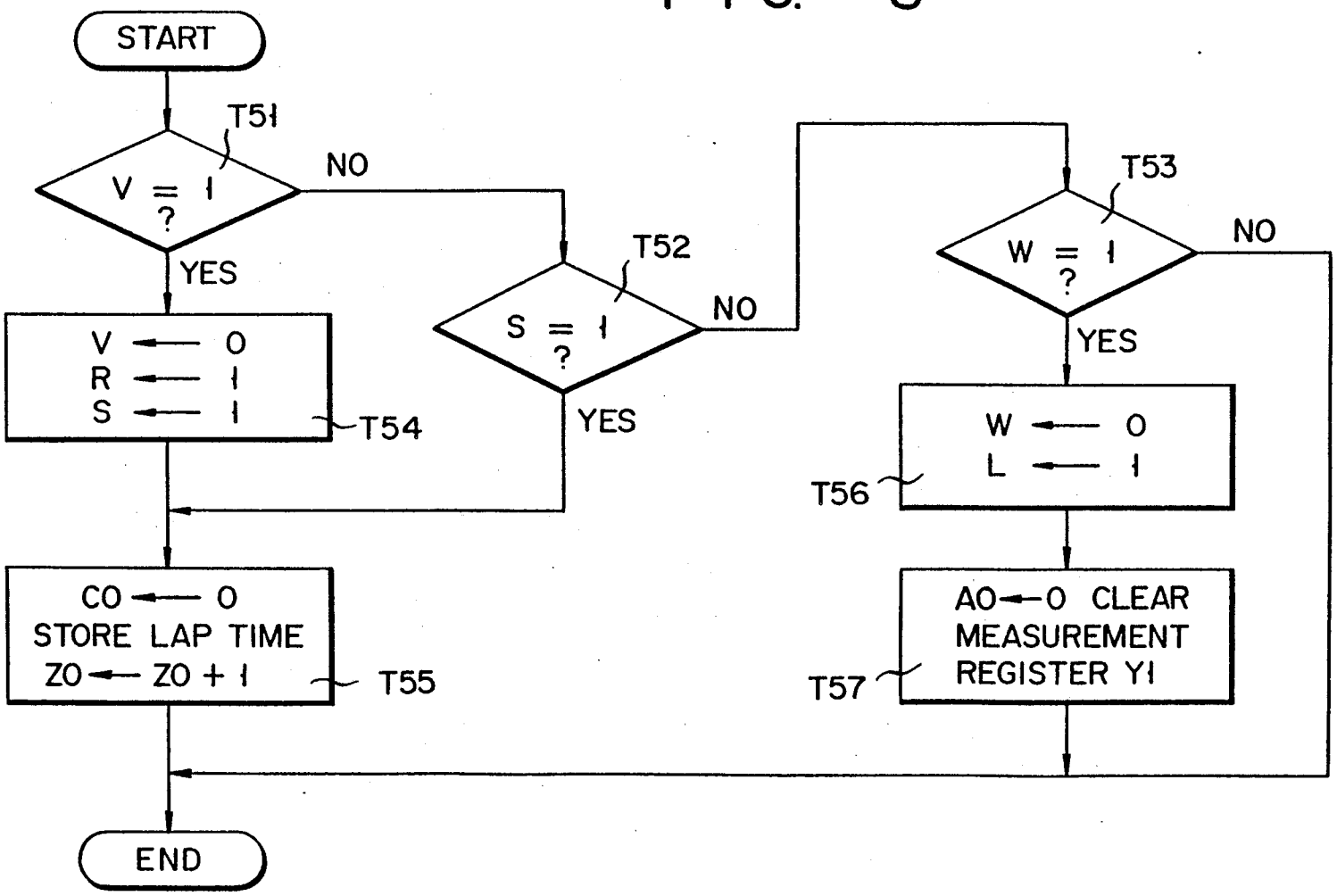
FIG. 8 is a flowchart of key processing when switch 3 is operated in the stop watch mode.

FIG. 8 is a flowchart when switch S3 is operated in the stop watch mode. When switch S3 is operated in the stop watch mode, the contents of mode registers V, S, and W are checked in steps T51 to T53, respectively, thereby discriminating a present mode.

LAP TIME MEASUREMENT OPERATION

When switch S3 is operated in the stop watch measurement mode (V=1), this is detected in step T51, and the flow advances to step T54. The content of mode register V is set to be "0", and the contents of mode registers R and S are set to be "1". Thus, the mode updating processing is performed. In this manner, the detail mode is switched from the measurement mode to the lap time measurement mode (S=1) in the lap time display mode (R=1). In step T55, 5-second counter C0 is cleared and started, and the total of previous lap times is subtracted from the measurement time upon operation of switch S3, i.e., "split time". The resultant value is stored in the data memory of RAM 20 as the lap time, and the content of empty address register Z0 is incremented by +1. When switch S3 is operated in the stop watch measurement mode in this manner, the lap time measurement mode is set, and the lap time at that time is stored. In this case, as shown in FIG. 4, the lap times are sequentially written in the data memories of RAM 20 together with their number of times data. S=1 in FIG. 11 illustrates the display state in this case, and measured lap time is displayed on upper display section 2. It should be noted that the time displayed on lower display section 4 corresponds to the present measurement time, i.e., split time upon depression of switch S4. After five seconds have passed in the lap measurement mode, the lapse of five seconds is detected in step T22 in FIG. 6, and the lap time measurement mode is canceled. Thus, the stop watch measurement mode is automatically set. If switch S3 is again operated before five seconds have passed in the lap time measurement mode, this is detected in step T52, and the flow advances to step T55. The above-mentioned processing, such as storage operation of the lap time at that time in the data memory area of RAM 20, and the like is performed.

Each time switch S3 is operated, the lap time at that time is obtained and stored. For example, as shown in FIG. 4, first lap time [1' 1" 32], second lap time [1' 1" 45], and third lap time [58" 97] are respectively stored in data memories X2, X3, and X4, and their number of times data are also stored accordingly. In this case, date data is stored in correspondence with the finish time, and is not stored in correspondence with each lap time.

RESET OPERATION

When switch S3 is operated in the stop watch stop mode (W=1), this is detected in step T53, and the flow advances to step T56. Thus, the content of mode register W is set to be "0", and the content of mode register L is set to be "1". The mode updating processing is performed in this manner, thereby switching from the stop watch stop mode to the reset mode. In step T57, the content of present start address register A0 is cleared, and the content of measurement register Y1 is also cleared.

KEY OPERATIONS OF SWITCH S4

The key processing for switch S4 will now be described. Switch S4 is used in various modes. In the stop watch mode, switch S4 is enabled only when the detailed mode is set in any of the reset mode (L=1), all-data recall mode (N=1), stop watch stop mode (W=1), and present data recall mode (P=1).

Figure 9:
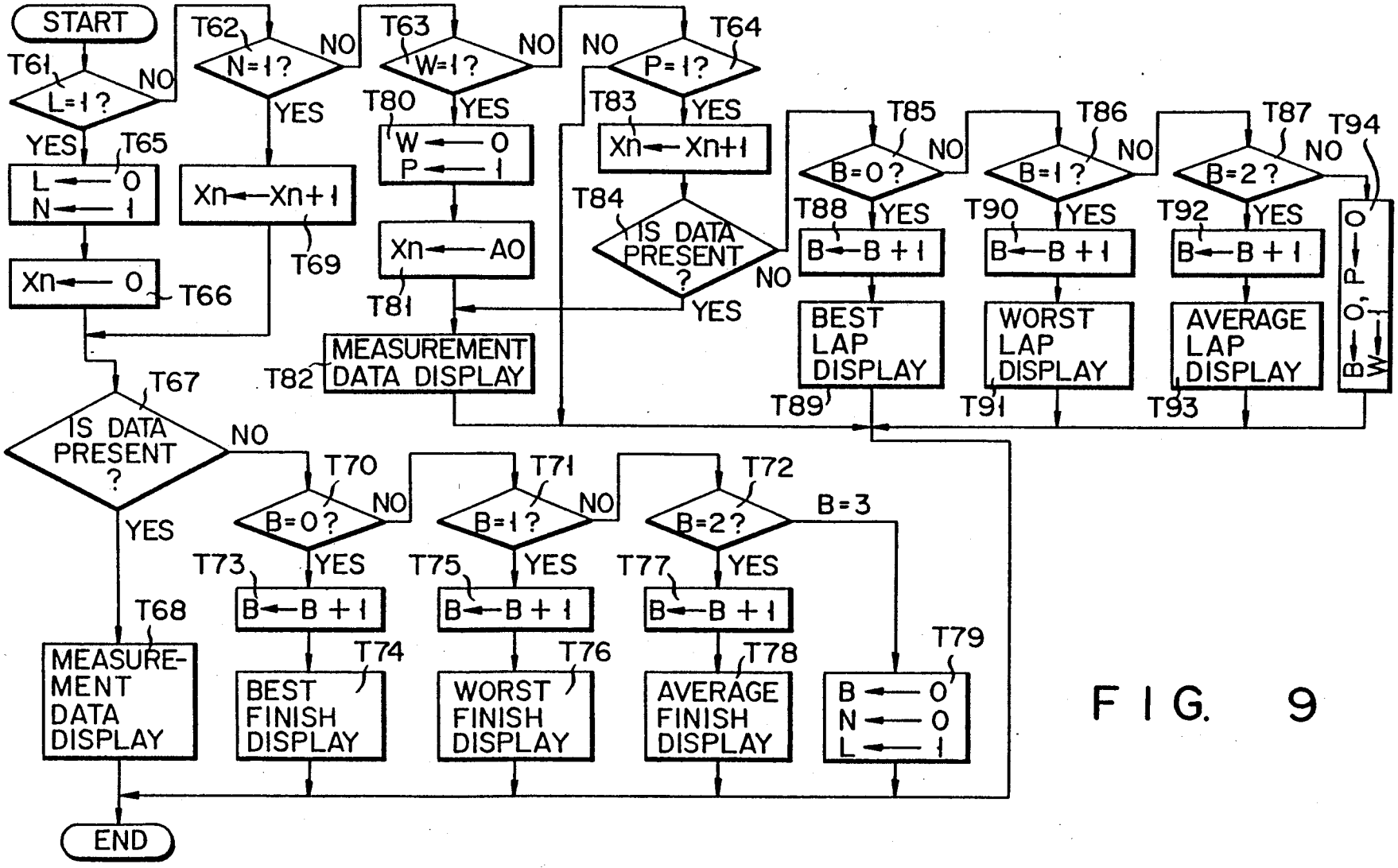
FIG. 9 is a flowchart of key processing when switch 4 is operated in the stop watch mode.

FIG. 9 is a flowchart when switch S4 is operated in the stop watch mode. When switch S4 is operated in the stop watch mode, the contents of mode registers L, N, W, and P are respectively checked in steps T61 to T64, thereby discriminating a present mode.

ALL DATA RECALL MODE

Assuming that switch S4 is operated in the reset mode, this is detected in step T61, and the flow advances to step T65. The content of mode register L is set to be "0", and the content of mode register N is set to be "1", thus performing the mode updating processing. The detailed mode is switched from the reset mode to the all-data recall mode (N=1). More specifically, in order to set the all-data recall mode, switch S4 can be operated once in the reset mode. When the all-data recall mode is selected in this manner, the content of pointer Xn is cleared in step T66. It is checked in step T67 if a data memory address-designated by the content of pointer Xn, in this case, data memory X0, stores measurement data. In this case, since data memory X0 stores the measurement data in correspondence with the date data, as shown in FIG. 4, the flow advances to step T68, and the content of data memory X0 is read out and then displayed. Precisely speaking, in step T68, to display the contents of data memory X0 in step T27 shown in FIG. 6, these contents are read out therefrom and transferred to a display buffer (not shown) of RAM 20. For the sake of simplicity, these data readout and display operations are performed in this step T68. In this case, the measurement date read from data memory X0 and the time data are sequentially displayed. More specifically, as shown in FIG. 12, when switch S4 is operated once in the reset mode (L=1) of the stop watch, date data (May 17, 85, Friday) is displayed. In this case, as shown in FIG. 12, "RO1" indicating the first measurement of the day is displayed on middle display section 3. After a predetermined period of time, e.g., 1 second, has passed in this state, measurement time data stored in data memory X0 is displayed. As shown in FIG. 12, finish time [19' 28" 36] is displayed on lower display section 4, and the stop mark display segment indicating the finish time is turned on on middle display section 3. In addition, the number of times of measurement "1" indicating the first measurement time data is displayed.

Since the all-data recall mode is already set under these conditions when switch S4 is depressed, the flow advances from step T62 to T69, and the content of pointer Xn is incremented by +1. Thereafter, the presence/absence of measurement data is checked in step T67. In this case, since data memory Xl stores date data and measurement time data as in data memory X0, a display similar to above is made. More specifically, upon second operation, date data (May 18, 85, Saturday) and "RO1" indicating the first measurement data of the day are displayed, and thereafter, the finish time [20' 13" 02] of the day is displayed. When switch S4 is sequentially operated as described above, the content of pointer Xn is incremented by +1 each time switch S4 is operated, and data memories X2 to X49 are address-designated. Therefore, measurement data stored in each data memory is sequentially displayed. When a data memory which stores the lap time is address-designated, the lap time and the finish time of that measurement are displayed. More specifically, as shown in FIG. 4, if three lap times were taken in addition to the finish time during the second measurement, the finish time is displayed on upper display section 2 upon third operation, and first lap time [1' 01" 32] stored in data memory X2 is displayed on lower display section 4. Similarly, upon fourth and fifth operations, the second and third lap times are sequentially displayed. Upon sixth operation, date data of the next measurement and the number of times of measurement of the day are displayed on middle display section 3. In this case, since the date data displayed is the same as the date data of the second measurement, the number of the measurement times is indicated as "RO2".

Measurement time data in data memory areas of RAM 20 are sequentially displayed in association with date data in this manner. When switch S4 is operated after the last measurement data is displayed, a data memory address-designated by pointer Xn corresponds to a nonused data memory. Therefore, no data is detected in step T67. If no data is detected in step T67, the content of mode counter B is checked in steps T70 to T72. Since the content of mode counter B is initially set to be "0", this is detected in step T70, and the content of mode counter B is incremented by +1 in step T73. Thereafter, a best finish time is retrieved in step T74, and the result data is displayed. More specifically, in step T74, all the finish times stored in data memories X0 to X49 of RAM 20 are compared to obtain the best time therefrom, and the obtained best time is displayed. In this case, as shown in FIG. 12, "FINISH", "BEST", and obtained best finish time [19′ 28″ 36] are respectively displayed on upper, middle, and lower display sections 2, 3, and 4. When switch S4 is depressed once more, since the present content of mode counter B is "1", this is detected in step T71, and the flow advances to step T75, so as to increment the content of mode counter B by +1. Thereafter, in step T76, the worst finish time is retrieved and displayed. More specifically, all the finish times stored in data memories X0 to X49 are compared to obtain the worst time, and the obtained time is displayed as the worst finish time. In this case, as shown in FIG. 12, "FINISH", "WORS", and worst finish time [22′ 19″ 63] are respectively displayed on upper, middle, and lower display sections 2, 3, and 4. When switch S4 is operated once more, since the present content of mode counter B is "2", this is detected in step T72. The content of mode counter B is incremented by +1 in step T77, and thereafter, an average finish time is calculated in step T78, and the resultant data is displayed in step T78. In step T78, all the finish times are added and are divided with the number of times of measurement. Thus, the average finish time is calculated and displayed. In this case, as shown in FIG. 12, "FINISH", "AVER", and average finish time [20′ 18″ 15] are respectively displayed on upper, middle, and lower display sections 2, 3, and 4.

When switch S4 is operated after all the measurement data stored in the data memories are displayed, as described above, the best finish time, the worst finish time, and the average finish time are selectively displayed each time switch S4 is operated. Therefore, in the all-data recall mode, since the best finish time, the worst finish time, and the average finish time are obtained and displayed, these data can be easily and accurately recognized. When switch S4 is operated once more while the average finish time is displayed, the flow advances to step T79. The content of mode counter B is set to be "0", the content of mode register N is set to be "0", and the content of mode register L is set to be "1". Thus, the mode updating processing is performed. In this manner, the detail mode is returned from the all-data recall mode (N=1) to the reset mode (L=1).

PRESENT DATA RECALL MODE

When switch S4 is operated in the stop watch stop mode (w=1), this is detected in step T63, and the flow advances to step T80. The content of mode register W is set to be "0", and the content of mode register P is set to be "1", thus performing the mode updating processing. In this manner, the detailed mode is switched from the stop watch stop mode (W=1) to the present data recall mode (P=1). In step T81, the content of present start address register A0 is transferred to pointer Xn, and thereafter, the content of a data memory address-designated by the content of pointer Xn is read out and displayed in step T82. FIG. 13 illustrates the display state in this case Upon first operation, the present date data and the finish time are sequentially displayed, and upon second operation and thereafter, the lap times are sequentially displayed. More specifically, since the present data recall mode is set upon first operation of switch S4, the flow advances from step T64 to step T83 upon second operation and thereafter, and the content of pointer Xn is incremented by +1. Thereafter, it is checked in step T84 if a data memory designated by the content of pointer Xn stores measurement data. If the corresponding data memory stores the measurement data, the content is read out and displayed. Therefore, each time switch S4 is operated, the present measurement data are sequentially displayed. When switch S4 is operated while the last measurement data is displayed, no data is detected in step T84. The flow then advances to step T85 to check if the content of mode counter B is "0". Since the content of mode counter B is initially set to be "0", the content of mode counter B is incremented by +1 in step T88, and the best lap time is retrieved and displayed in step T89. More specifically, the best lap time among lap times obtained during the present measurement is displayed. Subsequently, when switch S4 is operated once, the flow advances from step T86 to step T90, and the content of mode counter B is incremented by +1. The worst lap time among lap times obtained during the present measurement is retrieved and displayed in step T91. When switch S4 is further operated once, the flow advances from step T87 to step T92, and the content of mode counter B is incremented by +1. The present average lap time is calculated from lap times obtained during the present measurement in step T93, and is displayed. Therefore, since the best lap time, the worst lap time, and the average lap time of the lap times obtained during the present measurement are obtained and displayed in the present data recall mode, these data can be easily and accurately confirmed. When switch S4 is operated once while the average lap time is displayed, the flow advances to step T94, and the content of mode counter B is cleared. Then, the detailed mode is switched from the present data recall mode to the stop watch stop mode.

As described above, when all the data are to be recalled, switch S4 can be operated in the reset mode (L=1). When the present data is to be recalled, switch S4 can be operated in the stop watch stop mode (W=1). All the data or present data can be recalled in accordance with the mode. For this reason, when a user wants to know the present finish time or lap time upon completion of the present measurement, he can operate switch S4 to set the present data recall mode. Thus, he can immediately know the present data. In this manner, the present data can be efficiently and practically recalled.

KEY OPERATIONS OF SWITCH S5

The key processing for switch S5 will be now described. Switch S5 is used in various modes. In the stop watch mode, switch S5 is enabled only when the detailed mode is set in any of stop watch measurement mode (V=1), target time display mode (O=1), lap time display mode (R=1), and time difference display mode (U=1).

In the above-described embodiment, the writing operation of the date data into the data memory is performed in synchronism with the time measurement starting operation by switch S2. Alternatively, it may be performed in synchronism with the time measurement stopping operation by switch S2. Moreover, the writing operation of the date data may be performed only at the first measurement on the day, although it is done each time the time measurement is performed. In this case, such a date data writing operation is also performed in synchronism with the measurement starting, or stopping operation by switch S2.

In the previous embodiment, the lap time data is stored in the data memory. The split time data may be alternatively stored therein. In this case, the lap time obtained by subtracting the previously measured split time data from the measurement time data (i.e., the split time data) obtained by operating switch S3 in the stop watch measurement mode (V=1) for measuring the present lap time, is displayed on upper display section 4.

Figure 10:
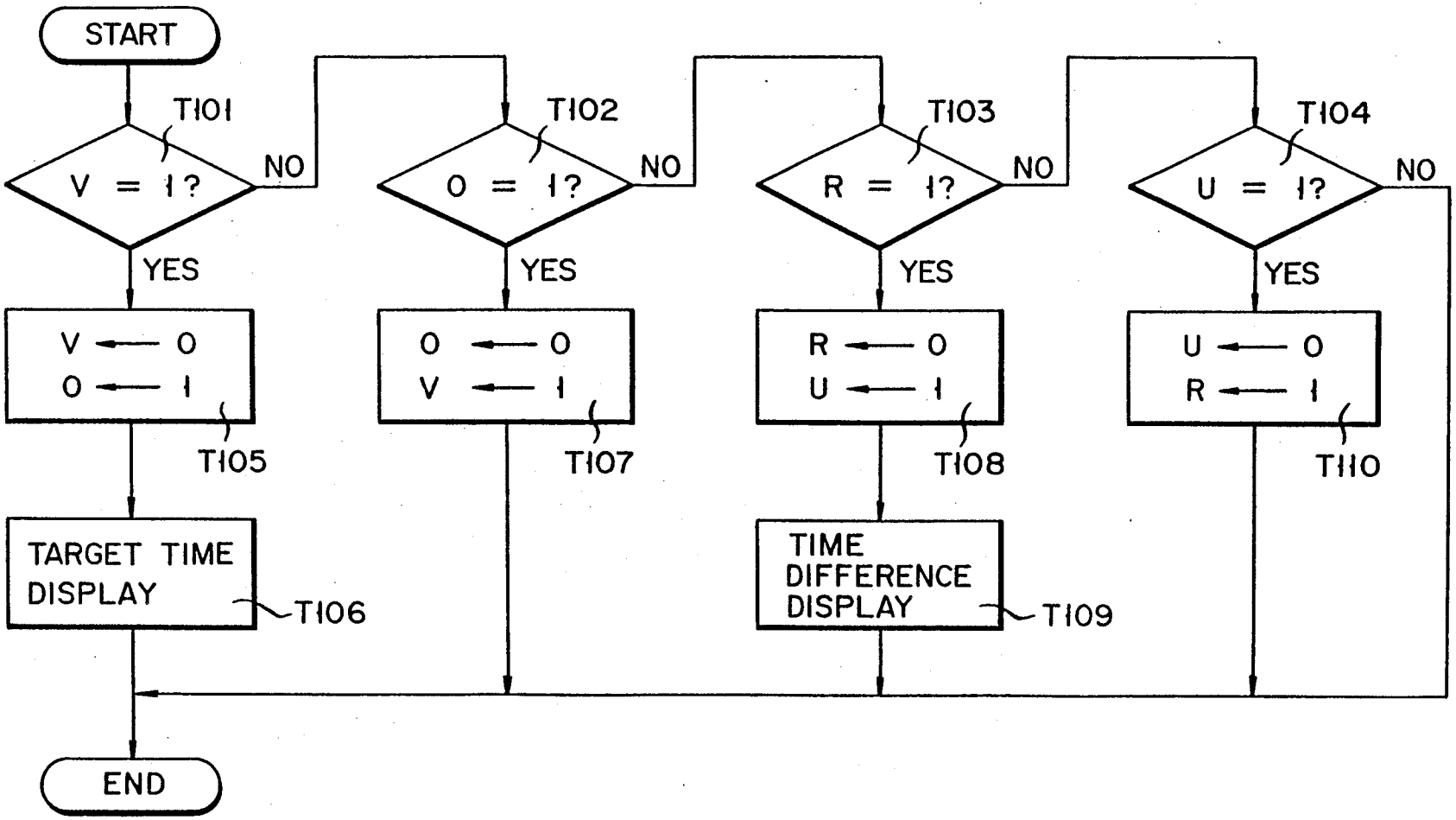
FIG. 10 is a flowchart of key processing when switch 5 is operated in the stop watch mode.

FIG. 10 is a flowchart when switch S5 is operated in the stop watch mode. When switch S5 is operated in the stop watch mode, the contents of mode registers V, O, R, and U are checked in steps T101 to T104, respectively, thereby discriminating a present mode.

TARGET TIME DISPLAY OPERATION

When switch S5 is operated once in the stop watch measurement mode (V=1), the flow advances from step T101 to T105. The content of mode register V is set to be "0", and the content of mode register O is set to be "1", thereby performing the mode updating processing. In this manner, control enters the target time display mode from the stop watch mode register In step T106, a target time prestored in target time setting memory PS is displayed in the target time setting mode (Q=1) (to be described later). More specifically, an proper target time in target times prestored in target value setting memory PS, i.e., a target time longer than and closest to the measurement time are read out and displayed, as indicated by O=1 in FIG. 11. Therefore, the target time can be confirmed during the measurement operation. When switch S5 is operated once in the target time display mode (O=1), the flow advances from step T102 to step T107. The content of mode register O is set to be "0", and the content of mode register V is set to be "1", thus performing the mode updating processing. More specifically, the target time display mode is canceled, and the stop watch measurement mode is resumed. If a user wants to know the target time, he can select the target time display mode. If he wants to know the present measurement time, he can cancel the target time display mode and select the stop watch measurement mode.

TIME DIFFERENCE DISPLAY OPERATION

When switch S5 is operated once in the lap time display mode (R=1), the flow advances from step T103 to T108, so that the content of mode register R is set to be "0" and the content of mode register U are set to be "1", thus performing the mode updating processing. In this manner, the detailed mode is switched from the lap time display mode to the time difference display mode. In step T109, the time difference is calculated and displayed. A difference between a presently measured split time and a prestored closest split target time is calculated, and the time difference is displayed on upper display section 2 (see U=1 in FIG. 11). In this case, the time difference between the measurement time and the target time is displayed together with plus/minus display segment 2-2 identifying a plus or minus time. When a user ran faster than the target time, a plus display is made; otherwise, a minus display is made. Thus, a user may know how much faster he can run than a target time when he actually passes a check point. In other words, before the target time passes, a remaining time to the target time is displayed, and after the target time has passed, an over-time display is made. Therefore, he may control a running pace. When switch S5 is operated once in the time difference display mode, the flow advances from step T104 to T110, so that the content of mode register U is set to be "0", and the content of mode register R is set to be "1", thus performing the mode updating processing. Then, the time difference display mode is canceled, and the lap time display mode is resumed.

KEY OPERATIONS OF SWITCH S6

The key processing for switch S6 will be described below. Switch S6 is used for setting and canceling the target time setting mode in the stop watch mode, and is enabled when the detailed mode of the stop watch is set in the reset mode (L=1) or the target time setting mode (Q=1).

More specifically, when switch S6 is operated in the reset mode (L=1), the target time setting mode (Q=1) is set. In this mode, a target split time can be set in advance before the stop watch measurement operation is started. As shown in FIG. 4, target times, e.g., [1' 00"], [2' .00"], and [3' 00"], are stored in target time setting memory PS. In this case, a flag indicating whether or not an alarm sound is produced at respective target times is also set. After the target times have been set, switch S6 is operated again. The setting mode is thus canceled, and the reset mode is resumed.

Figure 14A:
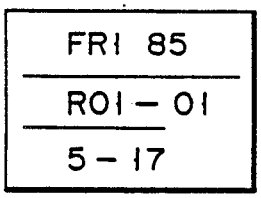
FIGS. 14(A) to 14(E) are views showing modifications of display states in the all-data recall mode shown in FIG. 12.
Figure 14B:
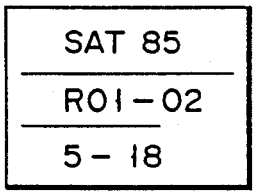
Figure 14C:
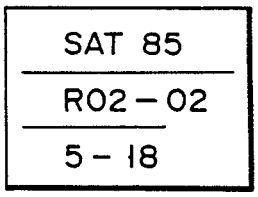

In the above embodiment, when the measurement date of each time measurement is displayed in the all-data recall mode (N=1), only measurement order data of the day is displayed as data representing the number of times of measurement. However, when the measurement data is displayed, data indicating the total number of times of measurement of the day can be simultaneously displayed. In this case, as shown in FIGS. 14(A) to 14(C), total measurement time data "01" or "02" is displayed on the right side of each measurement order data "RO1" or "RO2". If data of only a specific date is to be confirmed, the number of times of switch operations necessary for displaying the next measurement date can be observed each time the measurement date is displayed. Therefore, data of a specific date can be easily searched.

Figure 14D:
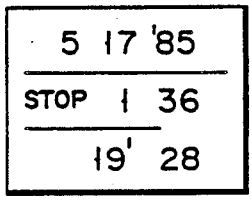
Figure 14E:
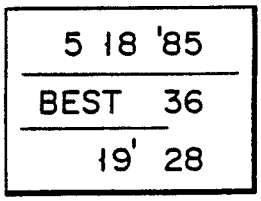

In the above embodiment, the measurement date data is displayed prior to display of the finish time. Alternatively, as shown in FIG. 14(D), the measurement date data and finish time data can be displayed at the same time. In addition, when the best finish or worst finish time is displayed, the corresponding measurement date data can be simultaneously displayed, as shown in FIG. 14(E).

In the above embodiment, the data recall mode includes the all-data recall mode and present data recall mode. Alternatively, date data may be input upon operation of switches, so that measurement data of a desired date or in a desired period can be recalled and displayed.

Figure 15B:
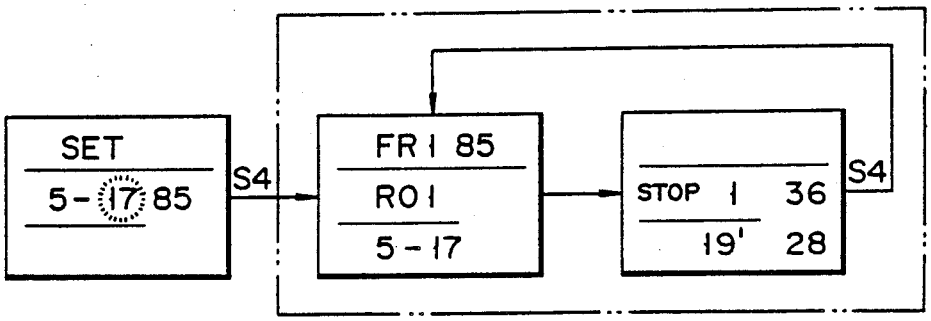
FIGS. 15A to 15C are diagrams showing display states in a date set mode and a designated day data recall mode.
Figure 15A:
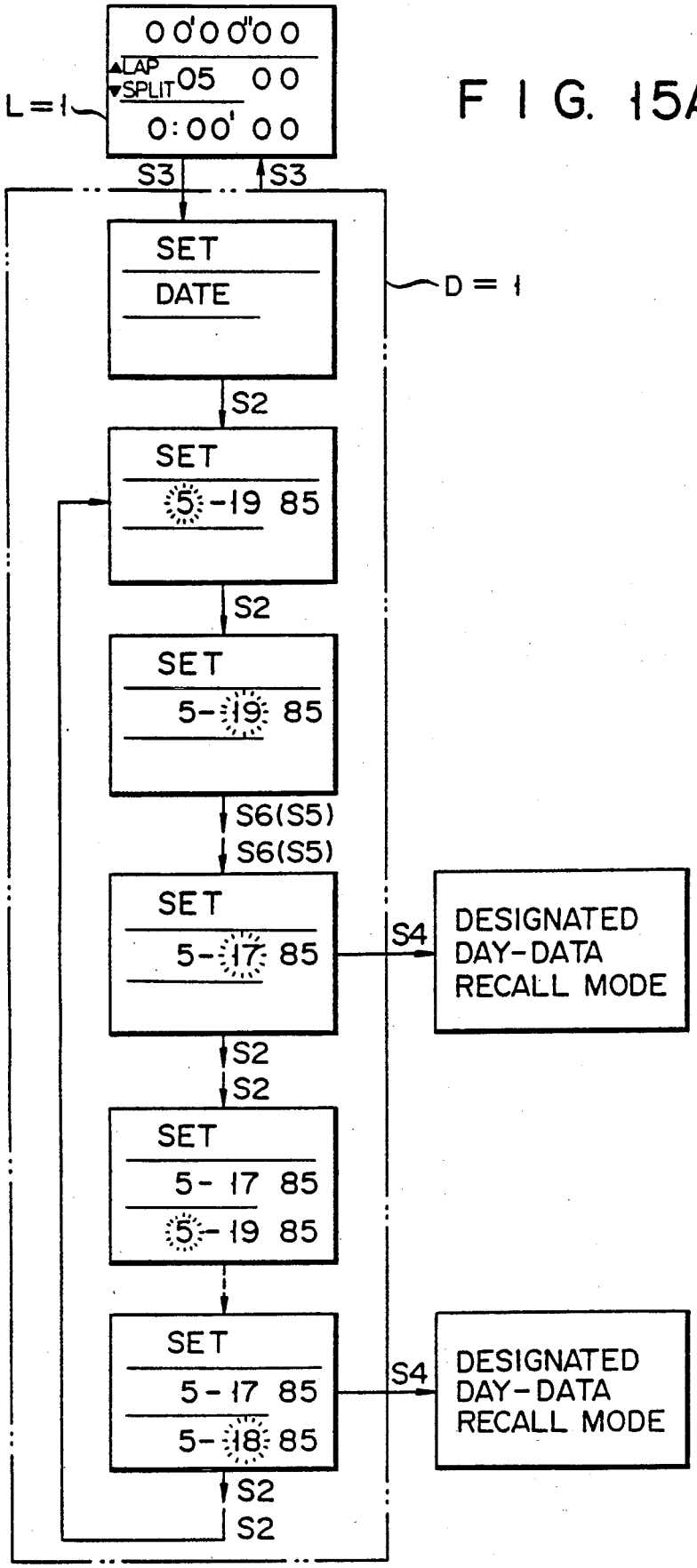
Figure 15C:
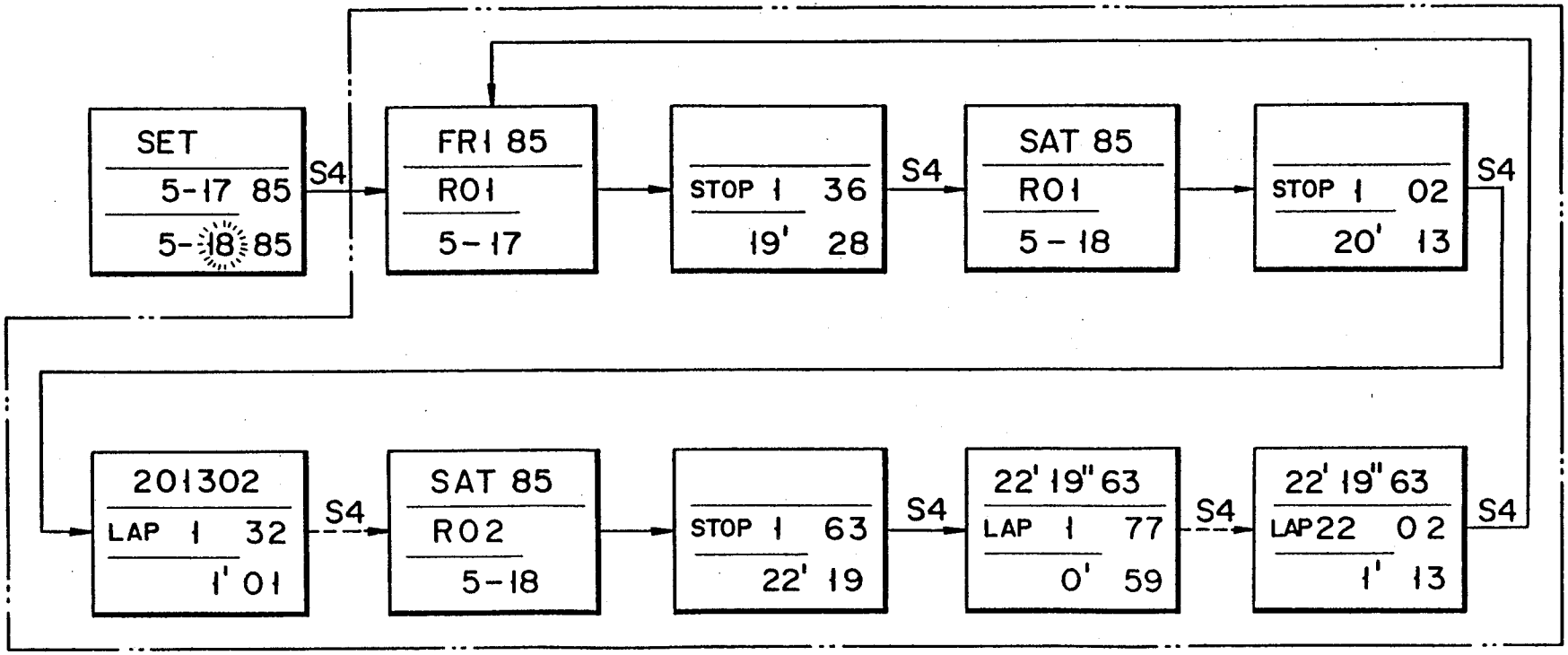

FIGS. 15(A) to 15(C) illustrate switch operation sequences and display states when a desired date and period are set and measurement data of the set date and period is displayed. When a desired date is set, switch S3 is operated in the reset mode (L=1) of the stop watch. Thus, the detailed mode of the stop watch is set in a date setting mode (D=1), and "SET" and "DATE" are respectively displayed on upper and middle display sections 2 and 3. Switch S2 is then operated. In response to this, "SET" and present date [May 19, 85] are respectively displayed on upper and middle display sections 2 and 3, and a first digit to be corrected, e.g., a month display digit, flashes. Data at a digit to be corrected can be decremented upon operation of switch S5 and can be incremented upon operation of switch S6. If a desired date corresponds to [May 17, 1985], switch S2 is operated again without operating switches S5 and S6. Thus, correction digits serve as date display digits. When switch S5 is operated twice in this state, the date display on middle display section 3 changes to desired date [May 17, 85]. When switch S4 is operated in this state, the designated day data recall mode (E=1) is set, and date data is displayed, as shown in FIG. 15A and 15B, in the same manner as in the all-data recall mode. Thereafter, the first finish time during the measurement of the day is displayed. After all measurement data are displayed upon operation of switch S4, the date data display is resumed upon next operation of switch S4. In this case, after all the measurement data are displayed, the best, worst, and average times of finish times or lap times may be displayed.

When a desired period is set, a start date is set on middle display section 3, and thereafter, an end date is set on lower display section 4. If the desired period corresponds to [May 17, 85] to [May 18, 85], switch S2 is operated twice in the state wherein the date display digits flash. Thus, present date [May 19, 85] is displayed on lower display section 4, and a month display digit flashes. When switch S2 is operated in this state and switch S5 is operated next, the date display on lower display section 4 is changed to end date [May 18, 85]. When switch S4 is operated in this state, the designated day data recall mode (E=1) is set. The finish data of the first measurement of the day is displayed after the date data is displayed in the same manner as in display in the all-data recall mode, as shown in FIG. 15C. After all the measurement data during the period are displayed upon sequential operation of switch S4, the date data display is resumed upon next operation of switch S4. In this case, after all the measurement data are displayed, the best, worst and average times of finish times or lap times may be displayed.

It should be noted that when switch S3 is depressed, both the data setting mode (D=1) and the designated day data recall mode (E=1) are changed to the reset mode (L=1). In other words, when switch S3 is depressed, the reset mode is selected by cancelling the present mode, i.e., either the data setting mode, or the designated day data recall mode.

Figure 16A:
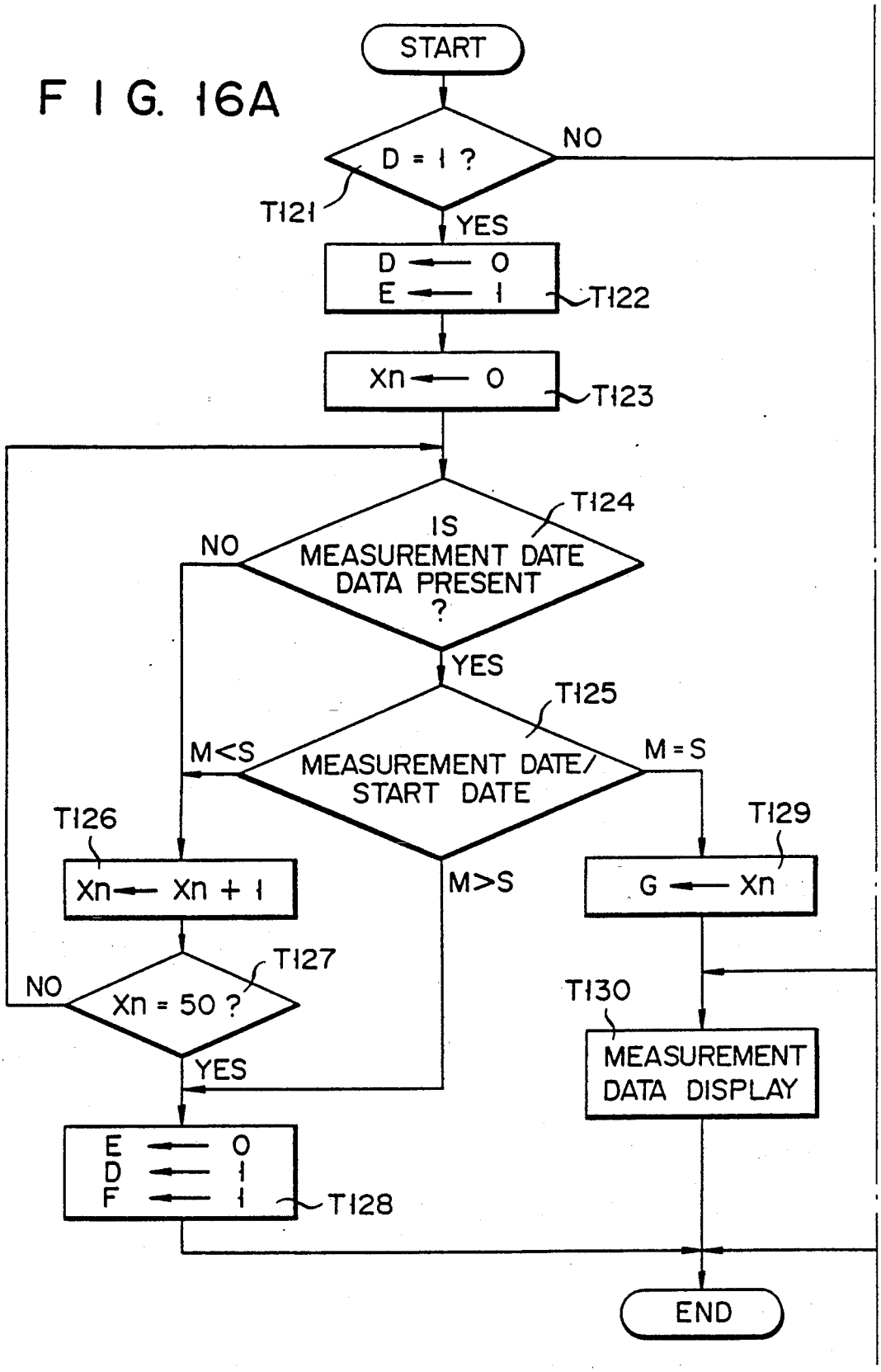
FIGS. 16A and 16B are flowcharts of additional key processing of switch S4 for controlling the designated day data recall mode.
Figure 16B:
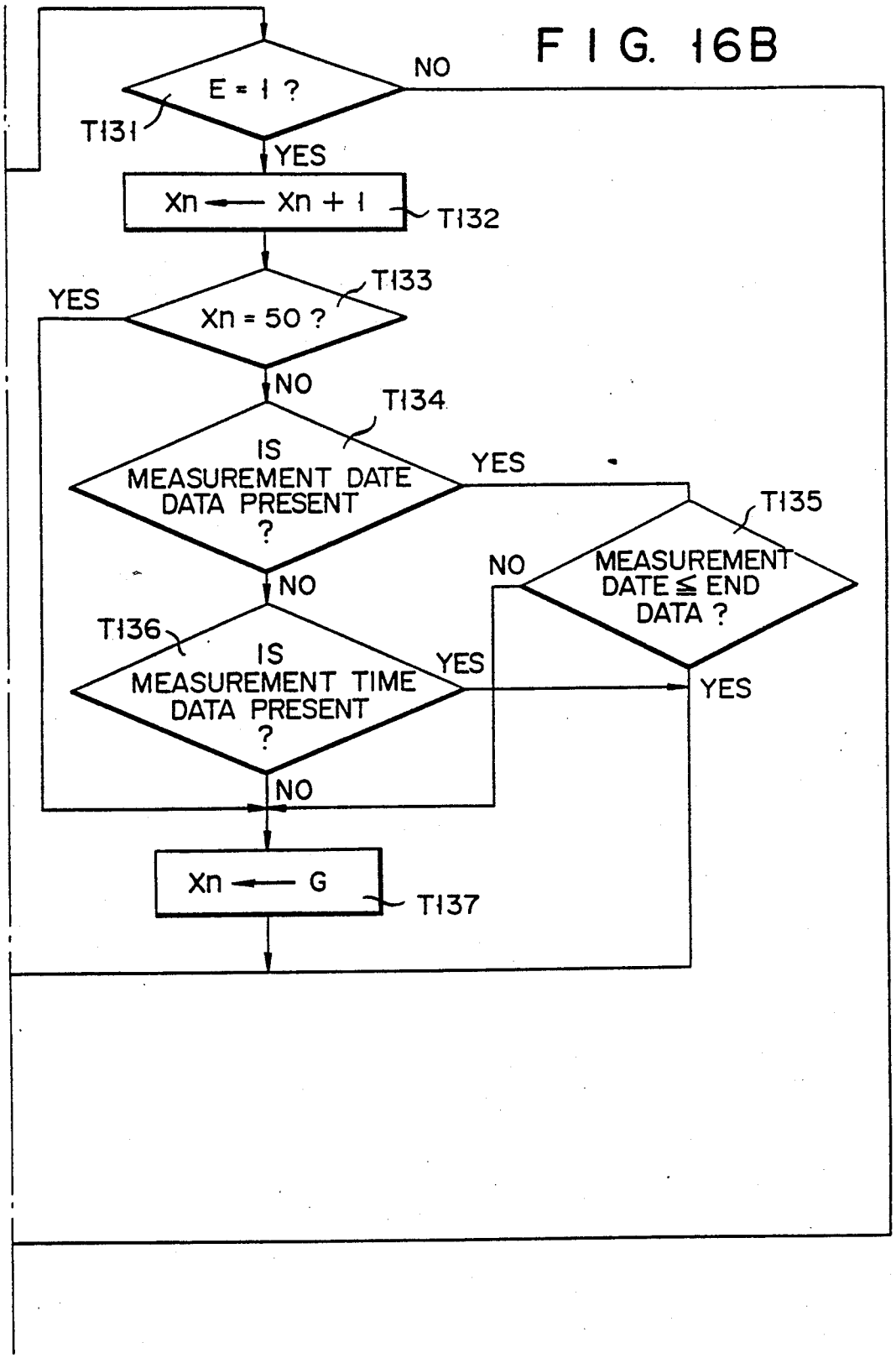

FIG. 16 is a flowchart of the key processing of switch S4 for controlling the designated day data recall mode shown in FIG. 15. The key processing flow is executed after "NO" is obtained in step T64 of the flow chart shown in FIG. 9. In this flow, it is checked in step T121 if the date setting mode (D=1) is set. If YES in step T121, the content of mode register D is set to be "0", and the content of mode register E is set to be "1" in step T122, thereby performing the mode updating processing. In this manner, the detailed mode is switched from the date setting mode (D=1) to the designated day data recall mode (E=1). In step T123, the content of pointer Xn is cleared, and it is checked in step T124 if a data memory address-designated by the content of pointer Xn, i.e., data memory X0, stores measurement date data. If YES in step T124, the flow advances to step T125 so as to compare the measurement date with a start date set in the date setting mode (D=1). If it is determined in step T125 that the measurement date is smaller than the start date and if no data is detected in step T124, the flow advances to step T126, and the content of pointer Xn is incremented by +1. When the content of pointer Xn is incremented by +1, it is checked in step T127 if the content of pointer Xn reaches 50. If NO in step T127, the flow returns to step T124. However, if YES in step T127, this means that the content of pointer Xn is greater than the number of data memories arranged on RAM 20, and the flow advances to step T128. In step T128, the content of mode register E is set to be "0" and the content of mode register D is set to be "1", thereby resuming the date setting mode (D=1). In addition, the content of mode register F is set to be "1", so that a flashing display mode is set in the date setting mode. If it is determined in step T125 that the measurement date is larger than the start date, the flow advances to step T128, so that the date setting mode is resumed and the flashing display mode is set. If it is determined in step T125 that the measurement date is equal to the start date, the content of pointer Xn is transferred to start address register G in step T129, and date data and finish data stored in a data memory address-designated by the content of pointer Xn is read out and displayed, in step T130. More specifically, as shown in FIGS. 15B and 15C, when switch S4 is operated once in the date setting mode (D=1), a designated day (or start date) is displayed, and thereafter, finish data of the day is displayed. When switch S4 is operated again in this state, since the detailed mode of the stop watch is set in the designated day data recall mode (E=1), the flow advances from step T131 to T132, so as to increment the content of pointer Xn by +1. Thereafter, it is checked in step T133 if the content of pointer Xn has reached 50. If YES in step T133, the flow jumps to step T137, and the start address data stored in start address register G is set in pointer Xn, and the flow then advances to step T130, thus resuming the previous display state. If NO in step T133, the flow advances to step T134 to check if a data memory address-designated by the content of pointer Xn stores measurement date data. If YES in step T134, the flow advances to step T135 to check whether or not the measurement date stored in the data memory is smaller than an end date set in the date setting mode (or the start date if only the start date is set). If No in step T134, the flow advances to step T136 so as to check whether the data memory address-designated by the content of pointer Xn stores the measurement time. If NO is obtained in steps T135 and T136, respectively, the flow advances to step T130 via step T137, and the previous display state is resumed. If YES is obtained in steps T135 and T136, respectively, the flow directly advances to step T130, and the measurement data stored in the data memory address-designated by the content of pointer Xn, which is updated in step T132, is displayed.

What is claimed is:

1. An electronic stop watch, comprising:

means for generating a reference clock signal;

elapsed time measuring means for obtaining elapsed time date by counting said reference clock signal;

start/stop control means for controlling said elapsed time measuring means so as to start or stop counting of said reference clock signal;

a first operation switch arranged to be operated while said elapsed time measuring means counts said reference clock signal under control of said start/-stop control means;

memory means for storing a plurality of elapsed time data items, each obtained by operating said first operation switch while said reference clock signal is counted by said elapsed time measuring means, and a plurality of elapsed finish time data items, each obtained when said elapsed time measuring means stops counting said reference clock signal under the control of said start/stop control means;

clear means for clearing said elapsed time data obtained by said elapsed time measuring means;

a second operation switch; and a display means for displaying at least one of best time data, worst time data, and average time data among said plurality of elapsed time data items, when said second operation switch is operated before said elapsed time data are cleared by said clear means, and for displaying at least one of best time data, worst time data, and average time data among said plurality of elapsed finish time data items stored in said memory means, when said second operation switch is operated after said plurality of elapsed time data are cleared by said clear means.

2. An electronic stop watch according to claim 1, wherein each of said elapsed time data items represents a time since said first operation switch is once operated until said first operation switch is next operated.

3. An electronic stop watch according to claim 1, further comprising operation times counter means for counting a number of times said first operation switch is operated.

4. An electronic stop watch according to claim 1, further comprising start/stop control means for controlling said elapsed time measuring means so as to start or stop counting of said reference clock signal, wherein said elapsed time data items stored in said memory means are obtained by said start/stop control means.

5. An electronic stop watch, comprising:

means for generating a reference clock signal;

elapsed time measuring means for obtaining elapsed time data by counting said reference clock signal;

start/stop control means for controlling said elapsed time measuring means so as to start or stop counting of said reference clock signal;

lap switch means arranged to be operated while said elapsed time measuring means counts said reference clock signal under the control of said start/-stop control means;

memory means for storing a plurality of elapsed time data items, each obtained by operating said lap switch means while said reference clock signal is counted by said elapsed time measuring means, and a plurality of elapsed finish time data items, each obtained when said elapsed time measuring means stops counting said reference clock signal under the control of said start/stop control means;

first display control means for displaying at least one of best time data, worst time data, and average time data among a plurality of elapsed time data items stored in said memory means by operating said lap switch means; and second display control means for displaying at least one of best time data, worst time data, and average time data among said plurality of elapsed finish time data items stored in said memory means under the control of said start/stop control means.

6. An electronic stop watch according to claim 5, wherein each of said elapsed time data items represents a time since said lap switch means is once operated until said lap switch means is next operated.

7. An electronic stop watch according to claim 5, further comprising operation times counter means for counting a number of times said lap switch means is operated.

8. An electronic stop watch according to claim 5, further comprising start/stop control means for controlling said elapsed time measuring means so as to start or stop counting of said reference clock signal, wherein said elapsed time data items stored in said memory means are obtained by said start/stop control means.

* * * * *

UNITED STATES PATENT AND TRADEMARK OFFICE

CERTIFICATE OF CORRECTION

PATENT NO. : 4,991,156

DATED : February 5, 1991

INVENTOR(S) : Fusao SUGA

It is certified that error appears in the above-identified patent and that said Letters Patent is hereby corrected as shown below:

On the Title Page:

Section 75 Inventor:

after Akishima, insert --Tokyo, Japan --.

Section 56 References Cited:

under "U.S. PATENT DOCUMENTS", insert

--4,540,292 9/1985 Rubenstein et al--

--4,657,405 4/1987 Nakazawa-- insert --FOREIGN PATENT DOCUMENTS--

--58-213280 12/1983 Japan

Signed and Sealed this

Ninth Day of February, 1993

*Attest:*

STEPHEN G. KUNIN

*Attesting Officer*

*Acting Commissioner of Patents and Trademarks*